US010935321B2

(12) United States Patent
Rule

(10) Patent No.: US 10,935,321 B2
(45) Date of Patent: Mar. 2, 2021

(54) ENERGY TRANSFER SYSTEMS AND ENERGY TRANSFER METHODS

(71) Applicant: David D. Rule, Weiser, ID (US)

(72) Inventor: David D. Rule, Weiser, ID (US)

(73) Assignee: KILR-CHILR, LLC, Weiser, ID (US)

( * ) Notice: Subject to any disclaimer, the term of this patent is extended or adjusted under 35 U.S.C. 154(b) by 192 days.

(21) Appl. No.: 15/547,591

(22) PCT Filed: Feb. 4, 2015

(86) PCT No.: PCT/US2015/014516

§ 371 (c)(1),
(2) Date: Jul. 31, 2017

(87) PCT Pub. No.: WO2016/126249

PCT Pub. Date: Aug. 11, 2016

(65) Prior Publication Data

US 2018/0023896 A1 Jan. 25, 2018

(51) Int. Cl.

| | |
|---|---|
| ***F28D 7/00*** | (2006.01) |
| ***F24D 11/02*** | (2006.01) |
| ***F24D 19/10*** | (2006.01) |
| ***F28F 3/12*** | (2006.01) |
| ***F28D 1/06*** | (2006.01) |
| ***F28D 1/02*** | (2006.01) |
| ***F25B 30/00*** | (2006.01) |

(52) U.S. Cl.

CPC ..... *F28D 7/0083* (2013.01); *F24D 11/0214* (2013.01); *F24D 19/1039* (2013.01); *F25B 30/00* (2013.01); *F28D 1/0213* (2013.01); *F28D 1/06* (2013.01); *F28D 7/0016* (2013.01); *F28F 3/12* (2013.01); *F24D 2200/12* (2013.01); *F24D 2220/08* (2013.01); *F28F 2270/00* (2013.01)

(58) Field of Classification Search

CPC ..... F28D 7/0083; F28D 1/06; F28D 1/0213; F28D 7/0016; F25B 30/00; F28F 3/12; F28F 2270/00

See application file for complete search history.

(56) References Cited

U.S. PATENT DOCUMENTS

| | | | |
|---|---|---|---|
| 20,722 | A | 6/1858 | Lyman |
| 348,116 | A | 8/1886 | Egan |
| 1,149,915 | A | 7/1915 | Marcuse |
| 1,338,129 | A | 4/1920 | Fries et al. |

(Continued)

FOREIGN PATENT DOCUMENTS

| | | | |
|---|---|---|---|
| CN | 2869694 | Y * | 2/2004 |
| CN | 203880986 | | 12/2014 |

(Continued)

OTHER PUBLICATIONS

Qi, Water Tank Special for Solar Air Conditioner, Feb. 14, 2007, CN2869694Y, Whole Document (Year: 2007).*

(Continued)

*Primary Examiner* — Larry L Furdge
(74) *Attorney, Agent, or Firm* — Wells St. John P.S.

(57) ABSTRACT

An energy transfer system that includes a tank comprising an outer wall having a circumference. A first fluid pathway surrounds a portion of the circumference of the tank. A second fluid pathway seals the portion of the circumference of the tank and the first fluid pathway from the environment.

31 Claims, 15 Drawing Sheets

(56) References Cited

U.S. PATENT DOCUMENTS 1,344,716 A 6/1920 Powell
1,540,806 A 6/1925 Rohn
1,561,769 A 11/1925 Bellew
1,588,707 A 6/1926 Calga
2,015,748 A 10/1935 Ireland
2,035,213 A 3/1936 Anderson
2,071,530 A 2/1937 Howard et al.
2,153,335 A 4/1939 Martin
2,167,160 A 7/1939 Raymond
2,193,316 A 2/1940 Floyd
2,277,526 A 3/1940 Mojonnier et al.
2,230,905 A 2/1941 Popky
2,316,273 A 4/1943 Ludwig et al.
2,333,751 A 11/1943 Turner
2,339,229 A 1/1944 Wyllie
2,356,779 A 8/1944 Monison
2,391,876 A 1/1946 Brown
2,422,394 A 6/1947 Carter
2,407,159 A 9/1948 Walton
2,610,478 A 9/1952 Lofstedt
2,662,749 A 12/1953 Buschow
2,887,618 A 8/1954 Bergstrom
2,715,627 A 8/1955 Mahltreller et al.
2,813,026 A 11/1957 Marcilly
2,751,672 A 6/1958 Reed
2,847,193 A 8/1958 Carter
2,874,629 A 2/1959 Kahan
2,985,435 A 5/1961 Gross
3,020,823 A 2/1962 Musso
3,120,902 A 2/1964 Southworth et al.
3,348,469 A 10/1967 Kasakoff
3,426,488 A 2/1969 Jarreby
3,458,917 A 8/1969 Mueller
3,469,415 A 9/1969 Corneilus
3,478,689 A 11/1969 Lanes
3,482,625 A 12/1969 Bray
3,484,212 A 12/1969 Cawi et al.
3,545,475 A 12/1970 Johnson, Jr. et al.
3,565,168 A 2/1971 Powell et al.
3,566,168 A 2/1971 Powell et al.
3,584,194 A 6/1971 Kautz et al.
3,625,280 A 12/1971 Anderson
3,643,733 A 2/1972 Hall et al.
3,693,825 A 9/1972 Richman
3,814,003 A 6/1974 Vacano
3,871,446 A 3/1975 Langenberg
3,871,466 A 3/1975 Langenberg
3,875,759 A 4/1975 Malcosky et al.
3,965,884 A 6/1976 Vignal et al.
4,002,111 A 1/1977 Pujol
4,002,200 A 1/1977 Raskin
4,036,899 A 7/1977 Quigg
4,086,691 A 5/1978 Smith
4,092,976 A 6/1978 Buckner
4,120,426 A 10/1978 Bethurum
4,146,089 A 3/1979 Mueller et al.
4,148,355 A 4/1979 Gehring
4,164,902 A 8/1979 Maarleveld
4,179,902 A 12/1979 Mueller et al.
4,206,237 A 6/1980 Sakata et al.
4,212,950 A 7/1980 Adams
4,216,659 A 8/1980 French
4,250,954 A 2/1981 Remlinger et al.
4,258,858 A 3/1981 Russel
2,991,628 A 7/1981 Tuck
4,305,456 A 12/1981 Mueller et al.
4,322,446 A 3/1982 Heess et al.
4,329,433 A 5/1982 Seebeck et al.
4,351,271 A 9/1982 Mueller et al.
4,413,747 A 11/1983 Tenold et al.
4,437,577 A 3/1984 Myers et al.
4,452,050 A * 6/1984 Pierce ..... F24H 4/04
165/169
4,487,785 A 12/1984 Epchtein
4,496,446 A 1/1985 Ritter et al.
4,498,446 A 2/1985 Judson
4,503,988 A 3/1985 Gerber
4,517,884 A 5/1985 Jandrich
4,532,142 A 7/1985 Dean
4,560,565 A 12/1985 Wucherpfennig et al.
4,561,040 A 12/1985 Eastman et al.
4,593,611 A 6/1986 Bruch
4,593,612 A 6/1986 Rieger
4,597,422 A 7/1986 Kovacevich
4,633,678 A 1/1987 Lea et al.
4,650,583 A 3/1987 Bondanini
4,664,669 A 5/1987 Davis
4,665,807 A 5/1987 Rieger
4,671,329 A 6/1987 Kovacevich
4,700,528 A 10/1987 Bernard
4,708,938 A 11/1987 Hickinbotham
4,710,292 A 12/1987 DeVos
4,711,163 A 12/1987 Capuano
4,711,785 A 12/1987 Bruch
4,759,403 A 7/1988 Flint et al.
4,790,238 A 12/1988 Hsu
4,792,454 A 12/1988 Lemonnier
4,814,189 A 3/1989 Laude-Bousquet
4,829,782 A 5/1989 Mueller et al.
4,856,421 A 8/1989 Whitford
4,889,805 A 12/1989 Da Silva et al.
4,908,219 A 3/1990 Modot et al.
4,909,948 A 3/1990 Eichelberger
4,910,642 A 3/1990 Downing et al.
4,969,391 A 11/1990 Haulot
4,979,377 A 12/1990 Fievet et al.
4,992,370 A 2/1991 Kalina
5,027,971 A 7/1991 Perryman
5,099,657 A 3/1992 Huang
5,101,637 A 4/1992 Daily
5,167,274 A 12/1992 Mueller
5,173,318 A 12/1992 Leu et al.
5,183,104 A 2/1993 Novotny
5,212,090 A 5/1993 Landine et al.
5,263,536 A 11/1993 Hulburd et al.
5,265,440 A 11/1993 Baker
5,265,651 A 11/1993 Perkins et al.
5,287,918 A 2/1994 Banks et al.
5,365,830 A 11/1994 MacLennan et al.
5,385,204 A 1/1995 Boardman et al.
5,424,083 A 6/1995 Lozito
5,427,276 A 6/1995 Knuettel, II et al.
5,505,256 A 4/1996 Boardman et al.
5,509,462 A 4/1996 Demko et al.
5,564,289 A 10/1996 Hino
5,802,863 A 9/1998 Cowans
5,867,991 A 2/1999 Jalink et al.
5,925,563 A 7/1999 Redford
5,972,402 A 10/1999 Scholl et al.
5,975,335 A 11/1999 Witenhafer
6,125,736 A 10/2000 Marin
6,182,454 B1 2/2001 McNeilan
6,252,018 B1 6/2001 Rupaner
6,279,457 B1 8/2001 Francia
6,328,184 B1 12/2001 Krol
6,397,624 B1 6/2002 Horwell
6,422,133 B1 7/2002 Brady
6,561,078 B1 5/2003 Hughes
6,622,615 B2 9/2003 Heczko
6,631,732 B1 10/2003 Koster et al.
6,656,916 B1 12/2003 Materna
6,702,002 B2 3/2004 Wang
6,703,055 B1 3/2004 Klein et al.
6,722,421 B2 4/2004 MacKelvie
6,805,885 B2 10/2004 Francia
6,877,504 B2 4/2005 Schreff et al.
6,964,223 B2 11/2005 O'Loughlin
7,353,750 B2 4/2008 Francia
7,685,715 B2 3/2010 Rule
7,870,891 B2 1/2011 Rule
9,920,289 B2 3/2018 Gentili
2001/0042443 A1 11/2001 Francia
2001/0050005 A1 12/2001 Wang
2002/0113072 A1 8/2002 Lane

(56) References Cited

U.S. PATENT DOCUMENTS

| | | | | |
|---|---|---|---|---|
| 2002/0174673 | A1* | 11/2002 | Wilkinson | F24D 5/12 62/260 |
| 2005/0224500 | A1 | 10/2005 | Hebblethwaite | |
| 2005/0274499 | A1* | 12/2005 | Rule | F24H 1/18 165/129 |
| 2005/0281911 | A1 | 12/2005 | Del Monte et al. | |
| 2007/0137494 | A1 | 6/2007 | Wilhite | |
| 2007/0264369 | A1 | 11/2007 | Rule | |
| 2008/0175951 | A1 | 7/2008 | Rule | |
| 2008/0576951 | | 7/2008 | Rule | |
| 2009/0301119 | A1* | 12/2009 | Chen | F24F 5/0007 62/235.1 |
| 2011/0259321 | A1 | 10/2011 | Lin | |
| 2012/0145095 | A1 | 6/2012 | Nelson | |
| 2013/0008188 | A1 | 1/2013 | McCormick | |
| 2013/0112155 | A1* | 5/2013 | Abdel-Rehim | F28D 20/0034 122/15.1 |
| 2013/0199460 | A1* | 8/2013 | Duplessis | F24H 9/165 122/13.01 |

FOREIGN PATENT DOCUMENTS

| | | | | |
|---|---|---|---|---|
| DE | 19517937 | | | 11/1996 |
| EP | 0530820 | | | 3/1993 |
| EP | 0737740 | | | 10/1996 |
| EP | 1229108 | A1 | | 8/2002 |
| EP | 1616937 | | | 1/2006 |
| FR | 2489709 | | | 3/1982 |
| FR | 2522677 | A1 | | 9/1983 |
| FR | 2627467 | A1 | | 8/1989 |
| FR | 2808282 | | | 11/2001 |
| FR | 1892728 | | | 5/2007 |
| FR | 2892728 | | | 5/2007 |
| GB | 2121820 | A | | 1/1984 |
| JP | 2014052087 | A | * | 3/2014 |
| WO | WO 8908698 | | | 9/1989 |
| WO | WO PCT/US07/010787 | | | 9/2008 |
| WO | WO PCT/US87/010767 | | | 9/2008 |
| WO | WO PCT/US07/010767 | | | 11/2008 |
| WO | WO 2014/177187 | | | 11/2014 |
| WO | PCT/US2015/014516 | | | 10/2015 |
| WO | WO PCT/US2015/014516 | | | 8/2017 |

OTHER PUBLICATIONS

Akai et al., Heat Exchanger for Hot Water Supply, Mar. 20, 2014, JP2014052087A, Whole Document (Year: 2014).*

"Wine-Refrigeration", produced by Pasco Poly Tank—all updated articles from Pasco Polly's Winery News, edited by Lawrence Dawson, publicaton date unknown (11 pgs).

Amerine et al., "The Technology of Wine Making". The Avi Publishing Company, Inc., 1972, pp. 364, 366 and 373-374.

Brewer, "What are Metals", Material Science and Technology Teachers Workshop, Univeristy of Illinois Champaign-Urbana, http://matse1.mse.uluc.edu.

Webster's Third New International Dictionary of the English Language Unabridged p. 1579 vol. II H-R Encyclopedia Britannica, Inc.

Crouch, D., "What Does It Mean for a Device to Be "Configured to" Perform a Particular Function?", Patently-O, Jan. 22, 2014, 3 pgs.

* cited by examiner

ENERGY TRANSFER SYSTEMS AND ENERGY TRANSFER METHODS

CROSS REFERENCE TO RELATED APPLICATION

This is a 35 U.S.C. § 371 application of, and claims priority to, International Application No. PCT/US2015/014516, filed on Feb. 4, 2015, and published as WO 2016/126249A1, the teachings of the application of which is incorporated herein by reference.

TECHNICAL FIELD

The invention pertains to energy transfer systems and energy transfer methods.

BACKGROUND OF THE INVENTION

There is always a need to enhance and improve energy transfer systems and methods, for example, by increasing the effectiveness and efficiency of the energy transfer that occurs in the energy transfer systems and methods.

BRIEF DESCRIPTION OF THE DRAWINGS

Preferred embodiments of the invention are described below with reference to the following accompanying drawings.

SUMMARY OF THE INVENTION

One aspect of the invention is an energy transfer system that includes a tank comprising an outer wall having a circumference. A first fluid pathway surrounds a portion of the circumference of the tank. A second fluid pathway seals the portion of the circumference of the tank and the first fluid pathway from the environment.

Another aspect of the invention includes an energy transfer method that includes providing a tank comprising an outer wall having a circumference. The method further includes providing a pathway structure around a portion of the circumference of the tank and circulating a first fluid through the pathway structure. The method further includes circulating a second fluid against the pathway structure and against the portion of the circumference of the tank.

DETAILED DESCRIPTION OF THE PREFERRED EMBODIMENTS

There is a need to increase the effectiveness and efficiency of thermal energy transfer from, and alternatively into, a material such as the contents of a container.

Figure 1:
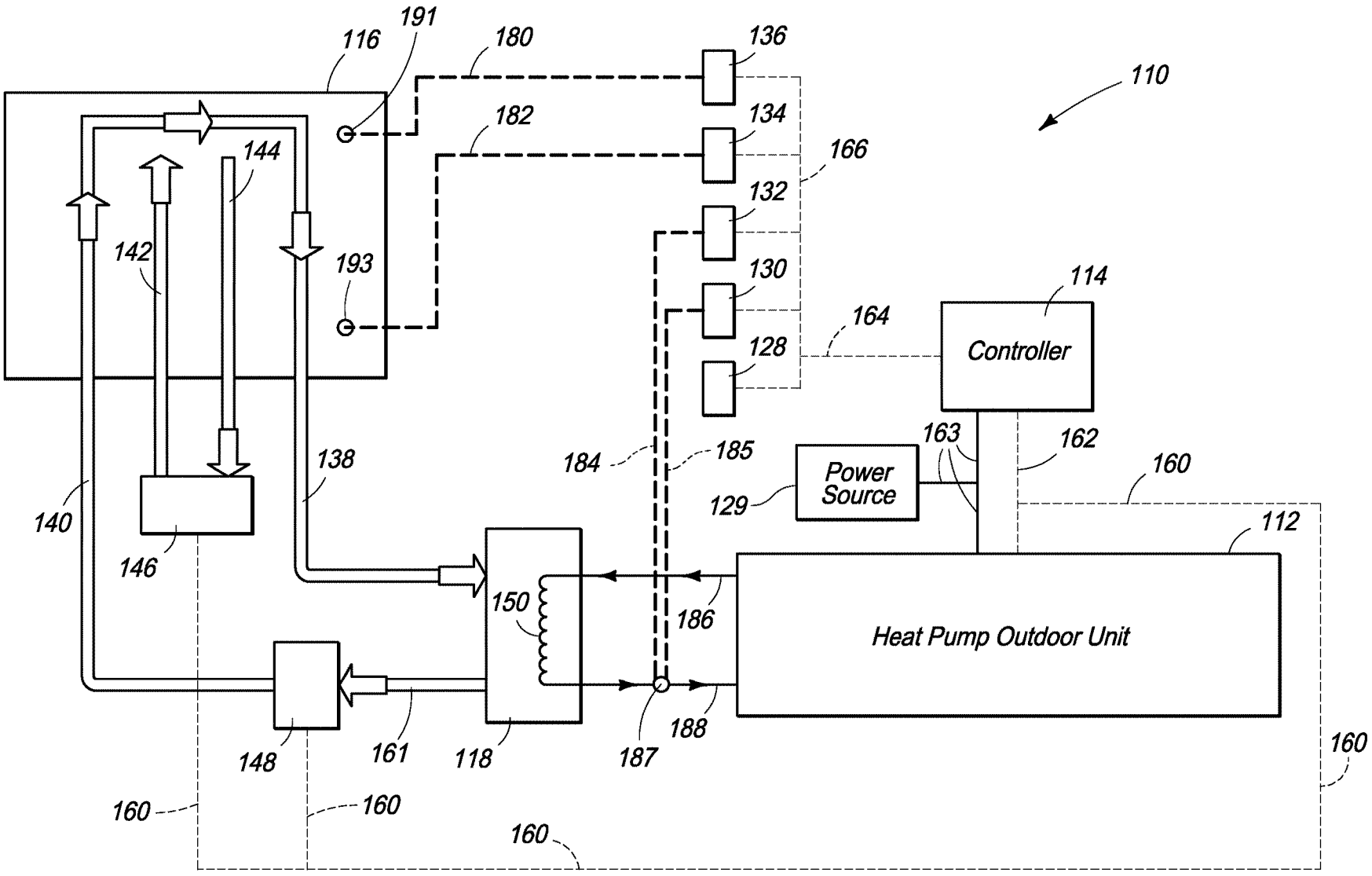
FIG. 1 is a schematic view of an exemplary energy transfer system according to one of various embodiments of the invention.

FIG. 1 illustrates an exemplary one of various embodiments of the inventions, in schematic form, and is directed to an energy transfer system 110 and methods for using same. Energy transfer system 110 is designed to transfer thermal energy to, and alternatively from, any selected or chosen configuration, mass and/or material. In any embodiment throughout this document, a configuration includes a vessel, container or tank and the contents therein. The energy transfer system 110 includes a heat pump 112. In any embodiment throughout this document, heat pump 112 can be a 4 horsepower, home heat pump, outdoor unit, using R22 Freon®. Heat pump 112 is electrically coupled to a power source 129, via electrical conduit 163, for electrical communication and which functions to power the heat pump 112 operationally on and operationally off. Heat pump 112 is electrically coupled to a controller 114 for electrical/data communication and functions to control aspects of the heat pump 112 discussed subsequently. Heat pump 112 includes first conduit 186 configured as a pathway for liquid Freon® and second conduit 188 configured as a pathway for gaseous Freon®.

Energy transfer system 110 further includes a heat exchanger 118 having a coil (or fluid circuit) 150 with two ends. One end of coil 150 is coupled to first conduit 186 of heat pump 112 in fluid communication. The other end of coil 150 is coupled to second conduit 188 of heat pump 112 in fluid communication. A glycol conduit 161 provides fluid communication between heat exchanger 118 and a pump 148. In any embodiment throughout this document, pump 148 moves glycol through a complete fluid circuit or pathway. An exemplary complete fluid circuit or pathway extends from heat exchanger 118 and includes: glycol conduit 161; pump 148; inlet conduit 140 extending from pump 148; inlet conduit 140 is coupled to outlet conduit 138; and outlet conduit 138 is coupled in fluid communication to heat exchanger 118. Reference number 116 indicates a schematic representation of the any selected or chosen configuration, mass and/or material for which thermal energy is transferred to, and alternatively from. Consequently, inlet conduit 140 and outlet conduit 138 are shown in proximity to configuration 116 to represent a proximity relationship between the structures. In any embodiment throughout this document, pump 148 can be an open vane, ⅓ horsepower, centrifugal high volume/low pressure pump with a head pressure capability of 2 pounds (lbs.) pressure at 15 feet.

In any embodiment throughout this document, the heat exchanger can be configured as a ⅜ inch copper tube for liquid Freon® that extends into an ¾ inch copper tube for the liquid Freon® to expand and become gaseous Freon® which extends entirely through a 1¼ inch polyethylene tube wherein the previously discussed glycol moves through the 1¼ inch polyethylene tube over and against the ¾ inch copper tube. Thermal energy is exchanged or transferred between the glycol and gaseous Freon®.

In any embodiment throughout this document and discussed subsequently, configuration 116 can represent a tank with fluid conduits proximate an outer surface of the tank, the fluid conduits including inlet conduit 140 and outlet conduit 138. Furthermore, an exemplary embodiment could have configuration 116 including a cover, for example, insulation provided over the outer surface of the tank, inlet conduit 140 and outlet conduit 138 (fluid conduits). In this configuration 116, energy transfer system 110 ultimately exchanges thermal energy with the contents in the tank.

The energy transfer system 110 includes another pump, or blower 146. An outlet 142 and an inlet 144 extend in fluid communication from blower 146. Outlet 142 and inlet 144 are shown in proximity to configuration 116 to represent a proximity relationship between the structures. In one embodiment, the previous description of configuration 116 representing a cover over a tank will include the outlet 142 and inlet 144 between the cover and tank. In this embodiment, the blower 146 moves air, described subsequently, against the tank outer surface, inlet conduit 140 and outlet conduit 138 (fluid conduits) to ultimately exchange thermal energy with the contents in the tank. In one embodiment, an exemplary pump or blower 146 is a 1 horsepower, 2 stage 10 cu.ft./min air pump.

Outlet 142 and inlet 144 are shown not connected (other than via blower 146), and therefore, do not form a direct coupling or direct completed passageway circuit by the structures of outlet 142 and inlet 144 themselves. However, it should be understood (and described subsequently) that blower 146 forces air from outlet 142 (and over and against the tank, the inlet conduit 140 and the outlet conduit 138) and back into inlet 144 to complete circuit for the movement of air. The air through blower 146, outlet 142 and inlet 144 is continually recirculated without needing to be replenished so the same volume of air is recirculated.

The energy transfer system 110 includes a defrost timer unit 128 and a plurality of temperature sensors 130, 132, 134 and 136 and all are coupled to controller 114 in electrical/data communication via conduits 164 and 166. Controller 114 is coupled to pump 148 and blower 146 in electrical/data communication via conduits 160 and 162. Temperature sensor 136 is coupled to an upper section of configuration 116 at node 191 in electrical/data communication via conduit 180. Temperature sensor 134 is coupled to a lower section of configuration 116 at node 193 in electrical/data communication via conduit 182. Temperature sensors 132 and 130 are coupled to second conduit 188 at node 187 in electrical/data communication via communication connections 184 and 185, respectively.

Still referring to FIG. 1, in this embodiment, temperature sensor 130 is a low temperature sensor (in another embodiment, temperature sensor 130 is a high temperature sensor) and temperature sensor 132 is a high temperature sensor (in another embodiment, temperature sensor 132 is a low temperature sensor). Further in this embodiment, temperature sensor 134 is a low temperature sensor (in another embodiment, temperature sensor 134 is a high temperature sensor) and temperature sensor 136 is a high temperature sensor (in another embodiment, temperature sensor 136 is a low temperature sensor). It should be further understood that nodes 191 and 193 are positioned at different locations on configuration 116 from each other and that nodes 191 and 193 can be placed at any location on configuration 116. As stated previously, heat pump 112 is electrically coupled to controller 114 for electrical/data communication and functions to control aspects of the heat pump 112. For example, pump 148 and pump 146 (blower) are activated (turned/powered on) when the heat pump 112 is activated (turned/powered on).

It should be understood that FIG. 1 represents the energy transfer system 110 in the cooling operation mode (cooling mode), that is, the energy transfer system 110 ultimately cools the contents of a vessel. Stated another way, in the cooling mode, the energy transfer system 110 removes thermal energy from the contents of the vessel and dissipates the thermal energy to the environment. In the cooling mode, liquid Freon® moves from the heat pump 112 through the first conduit 186 to heat exchanger 118 and gaseous Freon® moves from the heat exchanger 118 through the second conduit 188 to heat pump 112.

Figure 2:
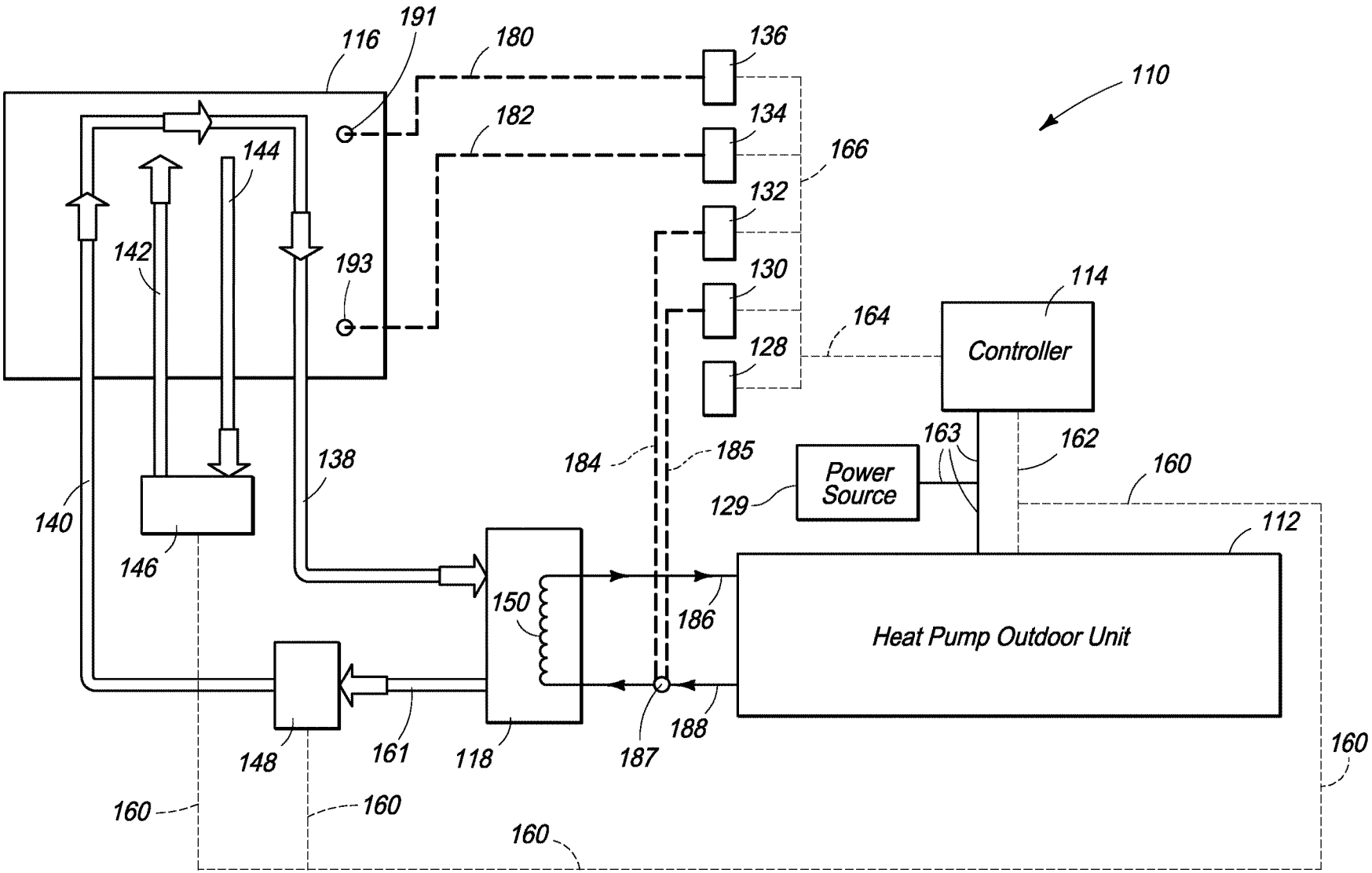
FIG. 2 is the energy transfer system of FIG. 1 shown in a different operation mode.

Referring to FIG. 2, represents the energy transfer system 110 in the heating operation mode (heating mode), that is, the energy transfer system 110 ultimately heats the contents of the vessel. Stated another way, in the heating mode, the energy transfer system 110 provides thermal energy into the contents of the vessel. In the heating mode, gaseous Freon® moves from the heat pump 112 through the second conduit 188 to the heat exchanger 118 and liquid Freon® moves from the heat exchanger 118 through the first conduit 186 to heat pump 112.

Temperature sensors (or controls) 130, 132, 134, 136 in one embodiment are Johnson Controls, for example, model 419. The temperature sensors are wired so that if threshold conditions of each unit are not reached or met, the heat pump 112 will not be prompted to activate for operation. The threshold conditions for unit 128 (defrost timer) determines when heat pump 112 will reverse its function from cooling mode to heading mode for approximately 15 minutes once every 4 hours. The purpose being to dissolve (melt) ice and frost build up on glycol pathways associated with configuration 116, for example, inlet conduit 140 and outlet conduit 138 and to dissolve (melt) ice and frost build up on coils in heat pump 112.

In more detail for the cooling mode, temperature sensor 136 (the heat limit/threshold control) is wired to control heating by system 110 until the threshold/set point is reached so it must be set to −10 degrees F. while system 110 is cooling so that it does not try to heat in conflict with the cooling mode. Still in the cooling mode, temperature sensor 134 (the cool limit/threshold control) is wired to control cooling by system 110 until the threshold/set point is reached. In the cooling mode, temperature sensor 134 is set to the threshold/set point temperature that is desired/selected for configuration 116. The temperature sensor 134 is in the lower quarter of the configuration 116 (tank) so that it will detect the coolest area.

In more detail for the heating mode, temperature sensor 134 (cool limit control) must be set to 110 degrees F. so that system 110 doesn't attempt to cool while in the heating mode. Furthermore, temperature sensor 136 (heat limit control) is set to the hot/upper threshold/set point and allows system 110 to heat as long as the cooling mode is set correctly, and until system 110 reaches the desired temperature level and then stops the operation of heat pump 112. If configuration 116 is a tank with liquid, then temperature sensor 134 is positioned in the liquid near the top surface of the tank in a floating probe because that is the hottest/warmest temperature in the tank 116.

In more detail with regard to defrost timer 128, when in either the cooling mode or the heating mode, the defrost timer 128 will reverse the operation mode of system 110 so that in the cooling mode it defrosts the cooling coils on the tanks or in the heating mode it defrosts the coils on the outdoor heat pump 112. Temperature sensor 132 turns the heat pump 112 off if it detects a cold temperature that may damage the heat pump 112. In one embodiment, this is not a customer control. Temperature sensor 130 (over/upper temperature limit control) turns the heat pump 112 off if it detects a hot temperature that may over heat the coils in the tank or damage the heat pump 112. In one embodiment, this is not a customer control.

Still referring to FIG. 1, exemplary methods of forming energy transfer systems 110 are described and exemplary methods of implementing, and using, the energy transfer system 110 are described. In one embodiment, the energy transfer system 110 includes a configuration 116 having a container or vessel (tank) wherein a hybrid cooling jacket is provided over at least a portion of an outer surface area of the container. In another embodiment, the energy transfer system 110 does not originally include a configuration 116 having a container or vessel (tank) wherein the hybrid cooling jacket is provided over at least a portion of an outer surface area of a container located at the site with the container or tank.

In various embodiments of the energy transfer systems 110, at least one or more of the following structures can be provided directly onto the container with the understanding that any combination of one or more of the following structures is possible: temperature sensors 130, 132, 134, 136, defrost timer unit 128, blower 146, pump 148, controller 114 and thermal exchanger 118. If any one, or any combination of, this list of structures is not placed directly on the container, then the any one structure, or any combination thereof, can be placed in a location remote from the container.

One embodiment of the energy transfer system 110 relies upon a fluid, for example a liquid such as glycol, as an energy medium (that is, a heat and/or cold source). Moreover, the energy transfer system 110 relies upon another fluid, for example a gas such as air, used as an energy transfer medium (or energy transfer source). Still further, the energy transfer system 110 includes yet another fluid, another gas, for example Freon®, used in the heat pump 112. In other embodiments, any one of the fluids, or any combination of the fluids, can be Freon®, ammonia, water, glycol, air, carbon dioxide, liquid sodium and/or mercury.

The power source 129 is turned on allowing electrical power to the energy transfer system 110. In the cooling mode, the condensed Freon® liquid cools the glycol cycling through the fluid circuit 150 of the thermal exchanger 118. Pump 148 pumps or pulls the cooled glycol from the heat exchanger 118 via conduit 161 into or proximate the configuration 116 via inlet conduit 140. The exemplary embodiment of the fluid circuit or pathway is a configuration of tubing or piping with exemplary materials being metal, plastic, PVC or any other conduit material. In one exemplary embodiment, the inlet conduit 140 leads into the fluid circuit or pathway (not shown here) that is formed in the configuration 116. In an embodiment, component of configuration 116 is an insulator provided over the fluid circuit or pathway.

Ultimately, the fluid circuit or pathway (not shown here) will extend from the inlet conduit 140 to the outlet conduit 138. Consequently, glycol will move through the inlet conduit 140, through the fluid circuit or pathway, through the outlet conduit 138 to ultimately reenter the thermal exchanger 118. The glycol is then cooled again in the thermal exchanger 118 and recycled and recirculated through the inlet conduit 140 to the outlet conduit 138. It should be understood that in this cooling mode for energy transfer system 110, the glycol moving through the inlet conduit 140 is cool. When the energy transfer system 110 is being used, for example in the wine industry, the glycol can range from about −20° F. to about 160° F. When the energy transfer system 110 is being used in other industries, such as managing reactor containments, the sodium (which would replace glycol in this embodiment) can range from about −250° F. to about 1500° F. As the glycol moves through the fluid circuit proximate the tank, and with the circulation gas (air) from blower 146 described subsequently, thermal energy is transferred from the contents of the tank, through the tank wall, through the fluid circuit wall and into the glycol. Consequently, as the glycol receives the thermal energy, the glycol will increase in temperature. The temperature of the contents of the tank is lowered while the temperature of the glycol is increased. The glycol exits the fluid circuit into the outlet conduit 138 to reenter the thermal exchanger 118 to be re-cooled.

However, with the use of just glycol tubes, the transfer of thermal energy is minimum and inefficient. The fluid pathway for the glycol and the tank wall routinely consist of conductive materials for effective thermal energy transfer. Moreover, fluid pathway for the glycol is routinely in direct physical contact with the outer wall of the tank for effective thermal energy transfer. As direct physical contact diminishes between the tank and the fluid pathway for the glycol, the transfer of thermal energy diminishes proportionally. Once the fluid pathway for the glycol separates from directly contacting the tank wall, the transfer of thermal energy effectively ceases.

However, energy transfer system 110 includes an energy transfer source that initiates, facilitates and promotes the thermal energy transfer between the contents of the tank and the glycol. In one exemplary embodiment, the energy transfer medium is a gas, for example air, that is moved over and in direct contact with the outer wall of the tank and passed over and in direct contact with the fluid pathway of the glycol (and thermal jacket 116 designed to house a portion of the fluid pathway). In this manner, the air efficiently and effectively transfers the thermal energy between the tank wall and the fluid pathway of the glycol.

In one exemplary method, the glycol moves through the fluid pathway proximate the tank. Additionally, air is moved though a fluid pathway (different from the fluid pathway for the glycol) that is opened to the tank outer wall and the fluid pathway for glycol. That is, the fluid pathway for the air includes or houses at least a portion of the fluid pathway for glycol and includes or houses at least a portion of the outer wall or surface of the tank. It should be understood that the fluid pathway for the air extends between the inlet 142 and the outlet 144. Accordingly, the air is circulated and recirculated, via pump 146, through inlet 142, over and in direct contact with the fluid pathway of the glycol and in direct contact with the outer surface of the tank, and ultimately through the outlet 144 to return to pump 146 to be recirculated. The circulating air initiates, facilitates and promotes the thermal energy transfer between the contents of the tank and the glycol. Without the circulating and recirculating air, the air stagnates between the fluid pathway for the glycol and the tank acting as an insulator which impedes, if not prevents, the thermal energy transfer between the contents of the tank and the glycol.

It should be understood that the same volume of air is moving through the system 110, and recirculating, and therefore, system 110 does not require a replenishing of volume of air and the attendant replenishing of energy provided to the air.

Figure 3:
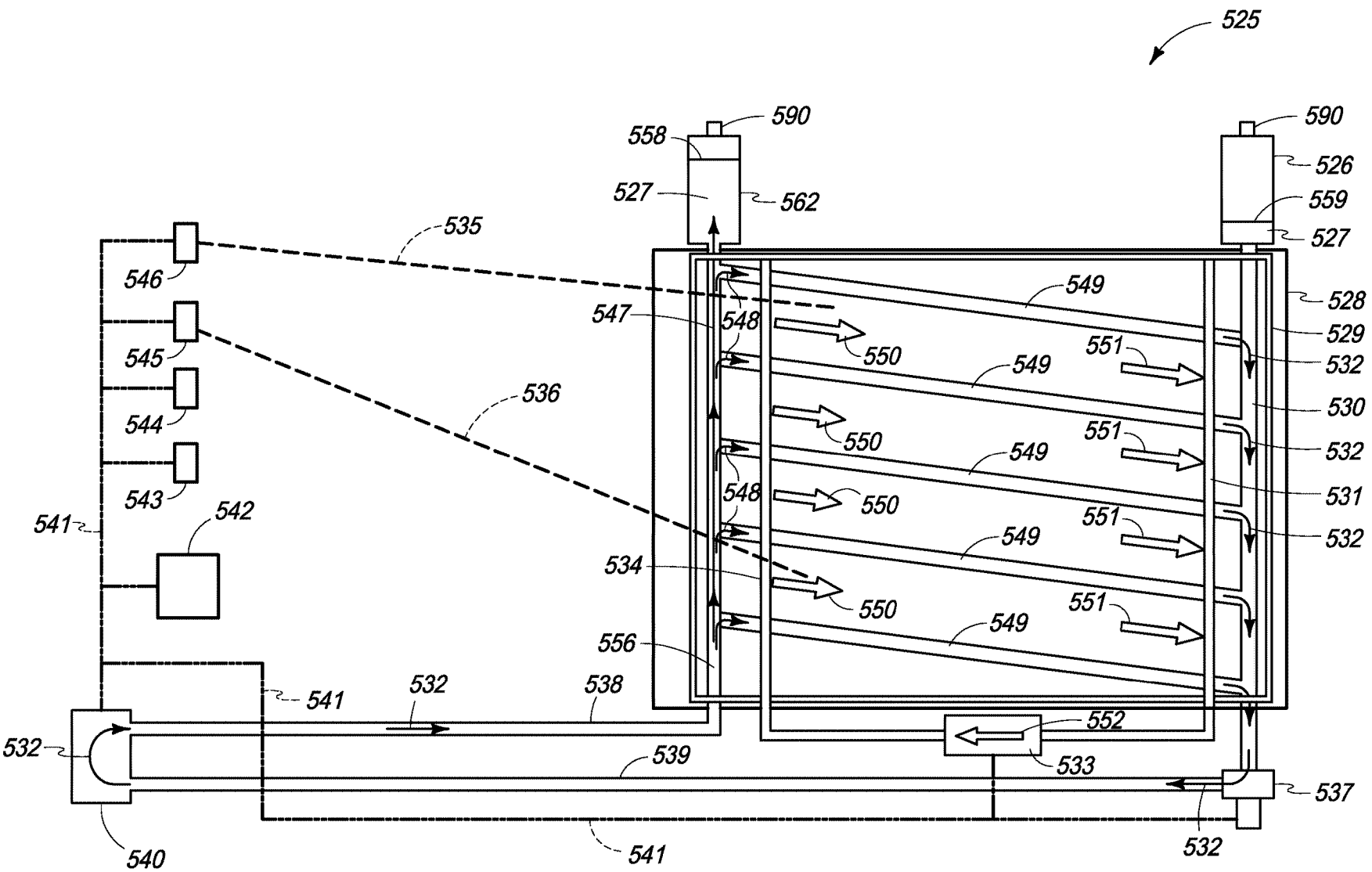
FIG. 3 is a schematic view of an exemplary energy transfer system according to one of various embodiments of the invention.

FIG. 3 illustrates an exemplary another one of various embodiments of the inventions, and is directed to an energy transfer system 525 and methods for using same, particularly with attention directed to the flow of air circuit and the flow of the glycol. Numerous structures, components and devices of energy transfer system 525 are the same as those described in FIGS. 1 and 2 for energy transfer system 110, and therefore, the same description is applicable here including any new or different description that follows. The same exemplary structures, components and devices include: configuration 528; outlet conduit 530 and inlet conduit 556 showing glycol travel/movement wherein outlet/inlet conduits 530 and 556 include cross tube sections 549; glycol travels/moves 532, 548, 547 through conduits 538 and 539; fluid pump 537 (also re-circulation pump) for glycol; heat exchanger 540; electrical conduits 535, 536, 541; sensors 543, 544, 545, 546 for temperature; defroster timer 542; pump 553 such as blower for air; inlet 531 representing the air manifold for air; outlet 534 representing the other air manifold for air; and air movement 552, 550, 551.

Still referring to FIG. 3, energy transfer system 525 illustrates an exemplary tank 529 not shown in FIGS. 1 and 2 but thoroughly discussed. For any exemplary new energy transfer system disclosed in this document, such may further include reservoirs 526, 562 (glycol reservoirs) as shown and discussed for energy transfer system 525. In one embodiment, inlet conduit 556 has a reservoir 562 as a topmost structure and outlet conduit 530 has a reservoir 526 as a topmost structure. Each reservoir 526, 562 receives, releases and stores a volume of glycol 527 wherein the respective glycol levels 558 and 559 are different for the respective reservoirs 562, 526. It should be understood that in other embodiments and during the operation of energy transfer system 525, glycol levels 558 and 559 may be the same and/or glycol level 559 may be at a higher level than glycol level 558. Each reservoir 526, 562 includes a vent or release valve 590 for venting to atmosphere or environment. It should be understood that in one embodiment, the energy transfer systems disclosed throughout this document include glycol in the system, for example, in reservoirs 526, 562 and associated structures in fluid communication with reservoirs 526, 562. In another embodiment, the energy transfer systems disclosed throughout this document will not include glycol in the system. Exemplary reservoirs 526, 562 can range in size from about 0.5 gallons to about 5 gallons.

Operation method of energy transfer system 525 includes head pressure caused by gravity on the height of a column of glycol fluid. The combination of glycol reservoirs 526 is a head equalization system that regulates the flow of glycol through this system 525 and negates the need for a mechanical pressure regulating system. Consequently, this head equalization system of energy transfer system 525 results in equal flow in all of the tubes at a very low and uniform pressure. Re-circulation pump 537 delivers fluid to the heat exchanger 540 at a specific pressure and volume determined by the dynamics and parameters (needs) of the energy transfer system. Heat is added or removed in heat exchanger 540 as the glycol flows 532 through heat exchanger 540 and conduit 538 until the glycol flow 547 is propelled through inlet conduit (manifold) 556 toward reservoir 562. On its way to reservoir 562, glycol flow 548 encounters openings in each cross tube section 549 wherein the glycol flow 548 can move through the openings which allows the flow rate to be determined by the particular design, for example, 0.5 gal per minute (assuming a 2.5 gal/min total for the 5 cross tube sections 549).

Ultimately, glycol as the energy medium, travels/moves from outlet conduit 530 through recirculation fluid pump 537, through conduit 539, through heat exchanger 540, through conduit 538, through inlet conduit 556 in direction of glycol flow 548, through cross tube sections 549 to return to outlet conduit 530. It should be understood that with just this glycol flow, there is not a significant amount of thermal energy being transferred as there is minimum surface area for the glycol pathway. However, as the air moves against the glycol pathway and against an entirety of the tank 529 surface, bounces between the glycol pathway and an entirety of the tank 529 surface, energy is being transferred between the glycol pathway and an entirety of the tank 529 surface.

Still referring to FIG. 3, the height of the glycol level 558 in reservoir 562 minus the glycol level 559 in the reservoir 526 accounts for one part of the head pressure. In one embodiment, the differences between the glycol levels 558, 559 in respective reservoirs 526 and 562 is approximately 1 foot. Another large factor affecting the glycol flow through the tubes 549 is the head pressure caused by the slope of the tubes 549 (as you move from the left of the page to the right of the page) which adds to the height difference of the reservoir glycol levels 558 and 559. In one embodiment, the slope of tubes 549 is approximately one foot. Combing the slope of 1 foot with the one foot representing the differences between the glycol levels 558, 559 equals a total of about 2 feet which correlates to about 1 lb./sq. in. pressure difference causing the flow of fluid of 0.5 gallons/minute per tube which is about 2.5 gallons/in flow total. As the column height difference of the glycol levels 558, 559 changes because of the many varying factors, for example, tube size liquid volume and the shrinkage of tubes and liquids because of temperature, the system 525 finds a new equilibrium for flow volume/minute which returns to pump 537 and is boosted again by pump 537 to counter act for losses of turbulence and flow resistance resulting in a stable flow.

A feature of energy transfer system 525 is that it prevents over pressure of the system 525 and allows for heat expansion, contraction and expansion of the glycol circuit or pathways which changes the total fluid volume of the system 525. This change in the total fluid volume of the system 525 changes the height of the glycol levels 558 and 559 which provides the necessary compensation. That is, rather than the change in the total fluid volume of the system 525 bursting or collapsing system 525 from pressure irregularities, the changes in the height of the glycol levels 558 and 559 maintains constant head pressure differences causing the flow of glycol and temperature changes in the tubes to remain stable at the particular conditions of temperature. As the resistance in the tubing might increase, the difference in glycol levels 558 and 559 increases the head pressure and increases the flow to reach equilibrium.

Still regarding FIG. 3 and energy transfer system 525, the air flow is boosted in pressure pump 533 in the direction towards outlet 534 wherein air leaves outlet 534 in direction 550. It should be understood that system 525 would work no differently if this air were flowing in the opposite direction of the figure or page. The air then enters the blower 533 and is boosted in pressure again and returned to the system 525 at a higher velocity and pressure, for example, 1.5 in water, additional pressure and 5 cubic feet/minute flow. It should be understood that head pressure is the pressure caused by gravity on the height of a column of fluid.

Figure 4:
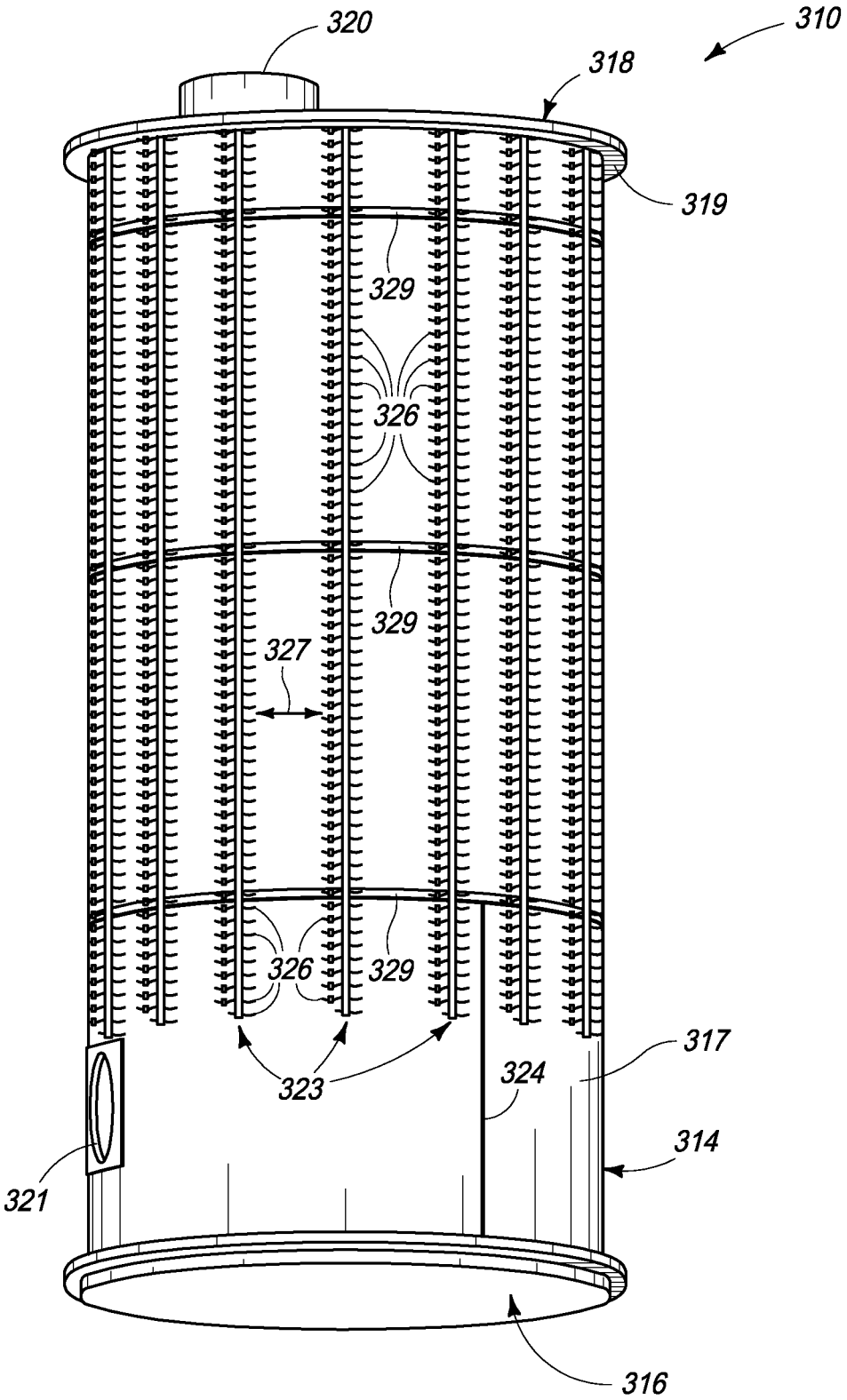
FIG. 4 is a perspective view of an exemplary method for designing an energy transfer system according to one of various embodiments of the invention.

FIG. 4 illustrates an exemplary one of various embodiments of the inventions and is directed to an energy transfer system 310 and methods for implementing and using the energy transfer system 310. Energy transfer system 310 includes a vessel or container, for example, a tank 314. An exemplary tank 314 can be made of any material, for example, metals or plastics. An exemplary tank 314 will be a size ranging from about one gallon to about 10,000 gallons, for example, from about 1,000 gallons to about 4,000 gallons, for example, 4,500 gallons. Tank 314 includes a bottom support surface 316, wall 317 and top 318. Tank 314 includes an upper sealing flange 319, wall seams 324, weld seams 329, a side manway 321, and an upper manway 320. Tube tie down strings 326 extend generally horizontally and are taped down onto the wall 317 by a plurality of vertically extending double-sided tape 323. Each tube tie down string 326 is spaced in a vertical direction and each double-sided tape 323 is spaced a distance 327 from each other around the circumference of the wall 317 of tank 314. Spacing distances 327 between respective double-sided tape 323 can range from about 12 inches to about 24 inches, for example, 18 inches.

Figure 5:
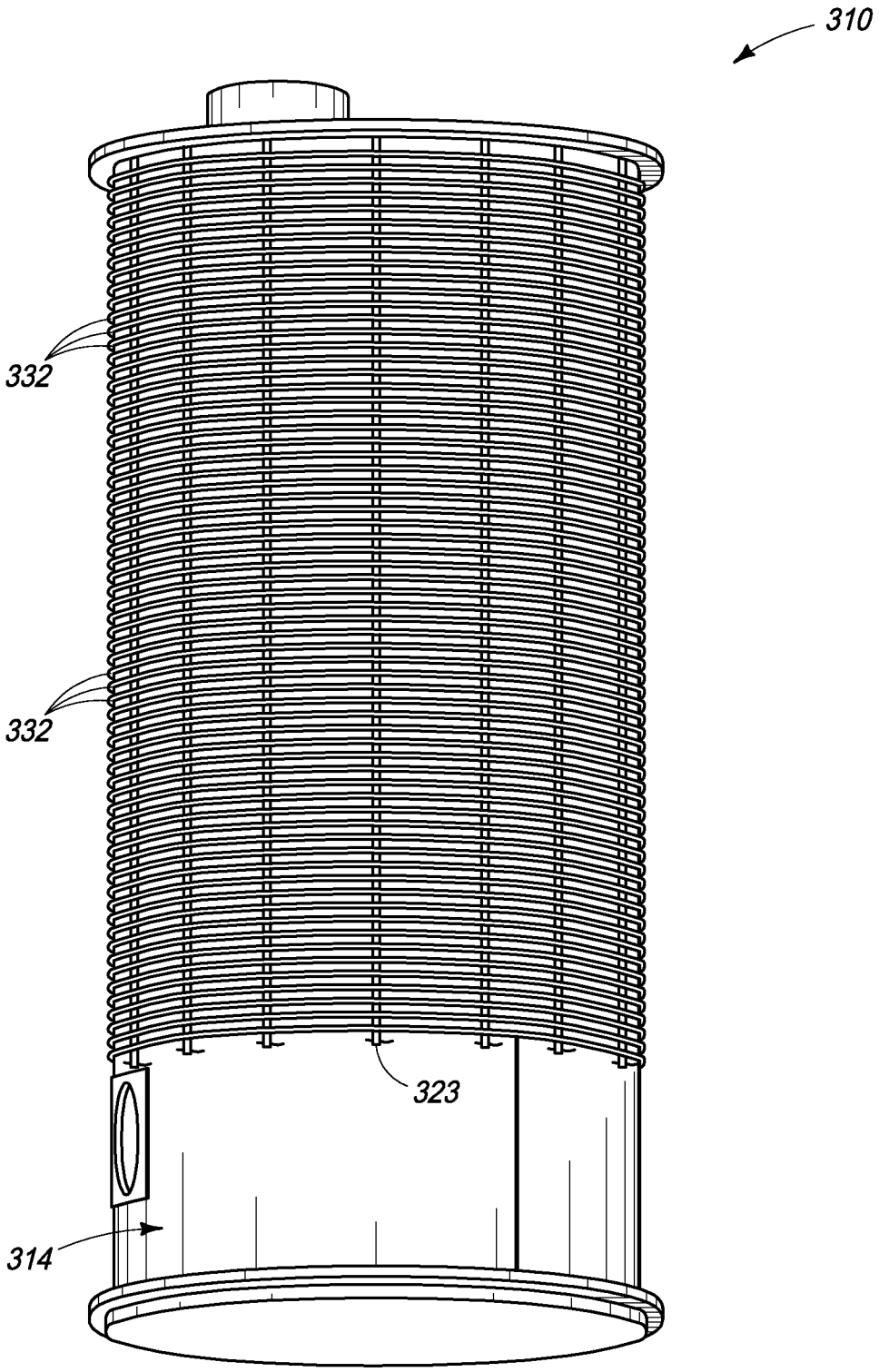
FIG. 5 is a perspective view of the FIG. 4 energy transfer system at a subsequent method step.

Referring to FIG. 5, first fluid tubes 332 are provided around the circumference of tank 314 and secured to the wall 317 by the tube tie down strings 326. First fluid tubes 332 can be polyethene tubes (or PVC) having a diameter ranging from about ⅛ inch to about one inch, for example, ⅝ inch in diameter. The distance between first fluid tubes 332 can range from about 1 inch to about 6 inches, for example, 2 inches.

Figure 6:
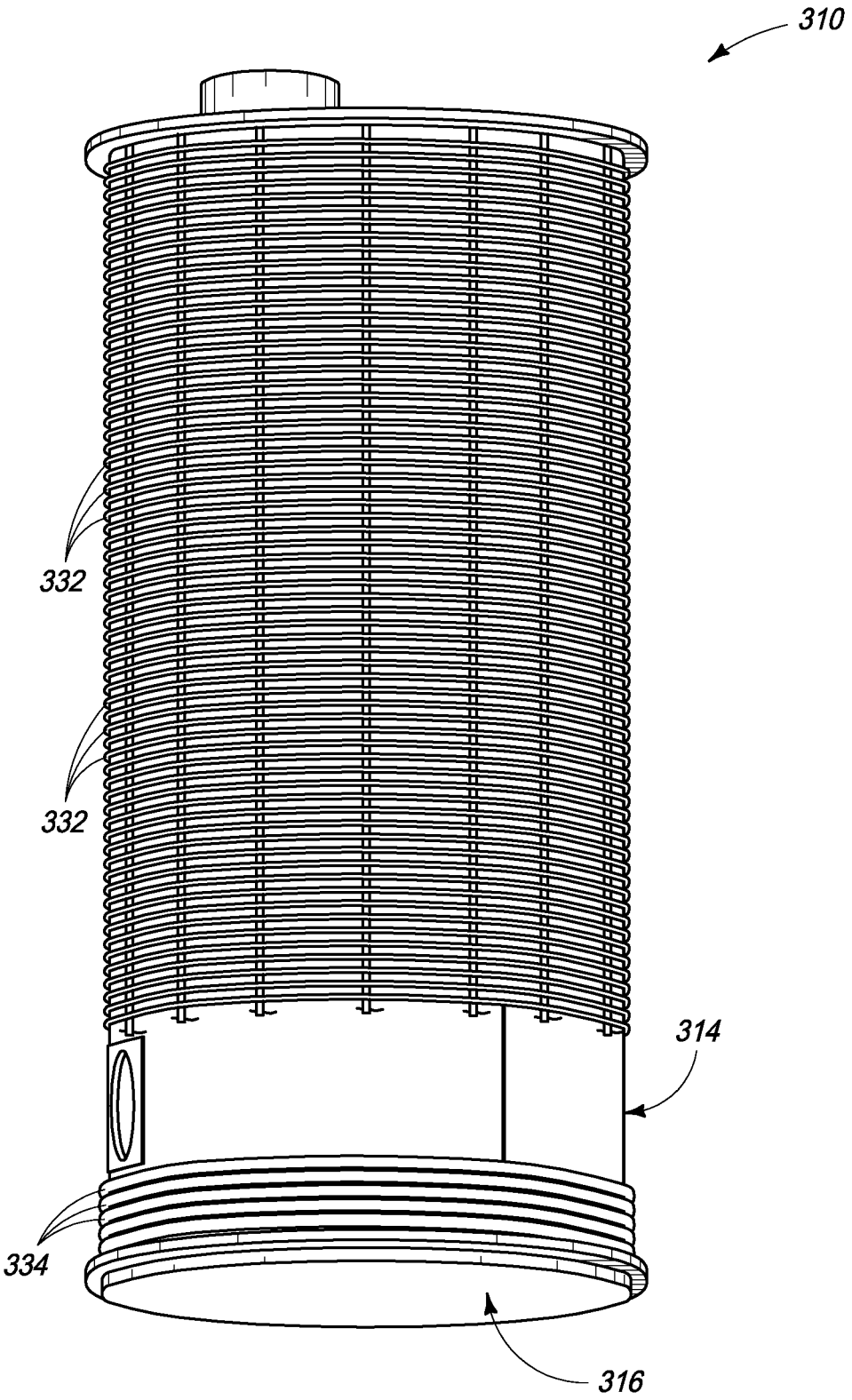
FIG. 6 is a perspective view of the FIG. 5 energy transfer system at a subsequent method step.

Referring to FIG. 6, a second fluid tube 334 is wrapped to surround a lower section of the circumference of tank 314 proximate the bottom support surface 316. In one embodiment, second fluid tube 334 wraps around the tank 314 at least five times, but other embodiments would include wraps ranging from 1 wrap to 10 wrap. A third fluid tube 336 (shown subsequently) is provided to extend through the second fluid tube 334. In one embodiment, second fluid tube 334 is a ¾ inch copper tube and third fluid tube 336 is a 1½ inch polyethene tubes (or PVC tube). In an exemplary embodiment of the energy transfer system 310, third fluid tube 336 is a pathway for Freon® and second fluid tube 334 is a pathway for glycol.

Accordingly, the Freon® of this embodiment (in second and third fluid tubes 334, 336 of energy transfer system 310) functions, and is used, in the same manner as the Freon® functions, and is used, in energy transfer systems 110 and 525 of FIGS. 1-3. Moreover, the glycol of this embodiment (in third fluid tube 336 of energy transfer system 310) functions, and is used, in the same manner as the glycol functions, and is used, in energy transfer systems 110 and 525 of FIGS. 1-3. Consequently, the combination of the second and third fluid tubes 334 and 336 functions, and is used, in the same manner as thermal exchangers 118 and 540 function, and are used, in energy transfer systems 110 and 525 of FIGS. 1-3.

Figure 7:
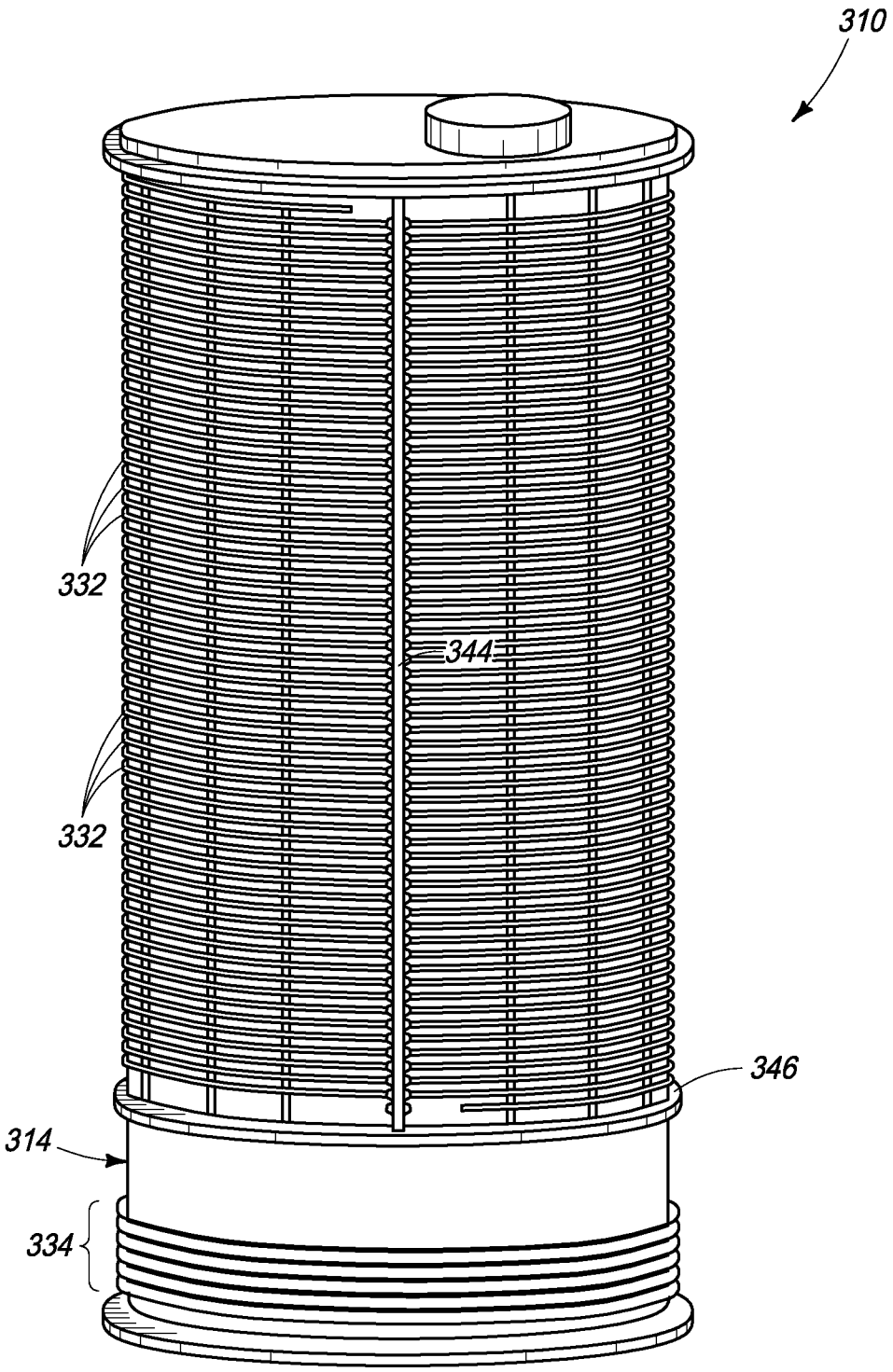
FIG. 7 is a perspective view of the FIG. 6 energy transfer system at a subsequent method step.

Referring to FIG. 7, energy transfer system 310 includes an air dam 344 provided to extend vertically in a line over the first fluid tubes 332. In one embodiment, the air dam 344 fills the spacing of volume between the respective first fluid tubes 332 along the vertical line established by the air dam 344. Moreover, an outermost edge of the air dam 344 is established to extend generally vertically and parallel to the outer surface wall of tank 314 a distance from the outer surface wall of tank 314 above the first fluid tubes 332. A lower sealing flange 346 is provided to surround the circumference of the tank 314 below the air dam 344.

Figure 8:
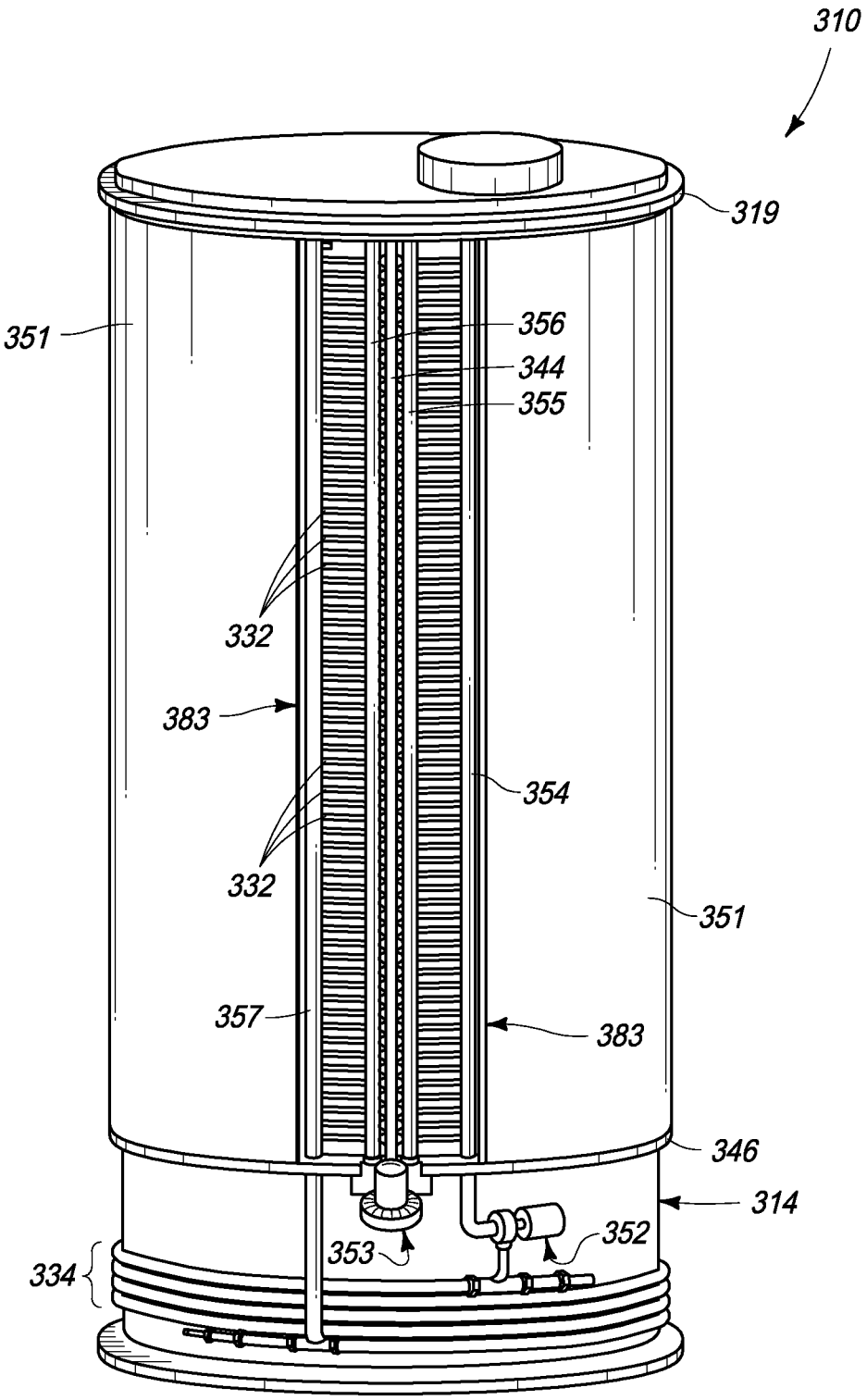
FIG. 8 is a perspective view of the FIG. 7 energy transfer system at a subsequent method step.

Referring to FIG. 8, energy transfer system 310 includes a first insulator (or first insulator wrap or first foam insulator) 351 provided to surround a portion of the circumference of tank 314 and cover the first fluid tubes 332 located at that portion of the tank circumference. In one embodiment, the first insulator 351 includes a bottom edge against the lower seal flange 346 and the first insulator 351 includes a top edge against the upper seal flange 319. First insulator 351 provides a seal from the environment relative to the portion of tank 314 that is covered by first insulator 351. By covering only a portion of the circumference of tank 314, the first insulator 351 leaves a portion of the tank 314 exposed through a window 383. Portions of first fluid tubes 332 are exposed through window 383. Furthermore, an inlet manifold 357, an outlet manifold 354, a return manifold 356, a source manifold 355 and the air dam 344 are exposed through window 383.

Still referring to FIG. 8, the energy transfer system 310 includes a pump 352 in fluid communication with second fluid tube 334 which in this embodiment, as stated previously, is a pathway for glycol. The outlet manifold 354 is in fluid communication with pump 352 and extends vertically over first fluid tubes 332 along and proximate a first vertical edge of window 383 of first insulator 351.

Still referring to FIG. 8, in one embodiment, pump 352 corresponds to the pumps for glycol of the previously described energy transfer systems. An inlet manifold 357 is in fluid communication with first fluid tubes 332 (and ultimately with pump 352 shown more thoroughly subsequently) and extends vertically over first fluid tubes 332 along and proximate a second vertical edge of window 383 of first insulator 351. In one embodiment, outlet manifold 354 corresponds to inlet conduit 140 of FIGS. 1 and 2. Inlet manifold 357 corresponds to outlet conduit 138 of FIGS. 1 and 2. Energy transfer system 310 includes another pump 353, in one embodiment, a blower. A return manifold 356 extends vertically along one side of air dam 344 and adjacent an opposite side of air dam 344 is a source manifold 355 extending vertically. Both return manifold 356 and source manifold 355 are in fluid communication with blower 353. In one embodiment, blower 353 corresponds to blower 146 of FIGS. 1 and 2; source manifold 355 corresponds to outlet 142 of FIGS. 1 and 2; and return manifold 356 corresponds to inlet 144 of FIGS. 1 and 2. Accordingly, in one embodiment, a gas, for example air, will circulate through blower 353, source manifold 355 and return manifold 356.

Figure 9:
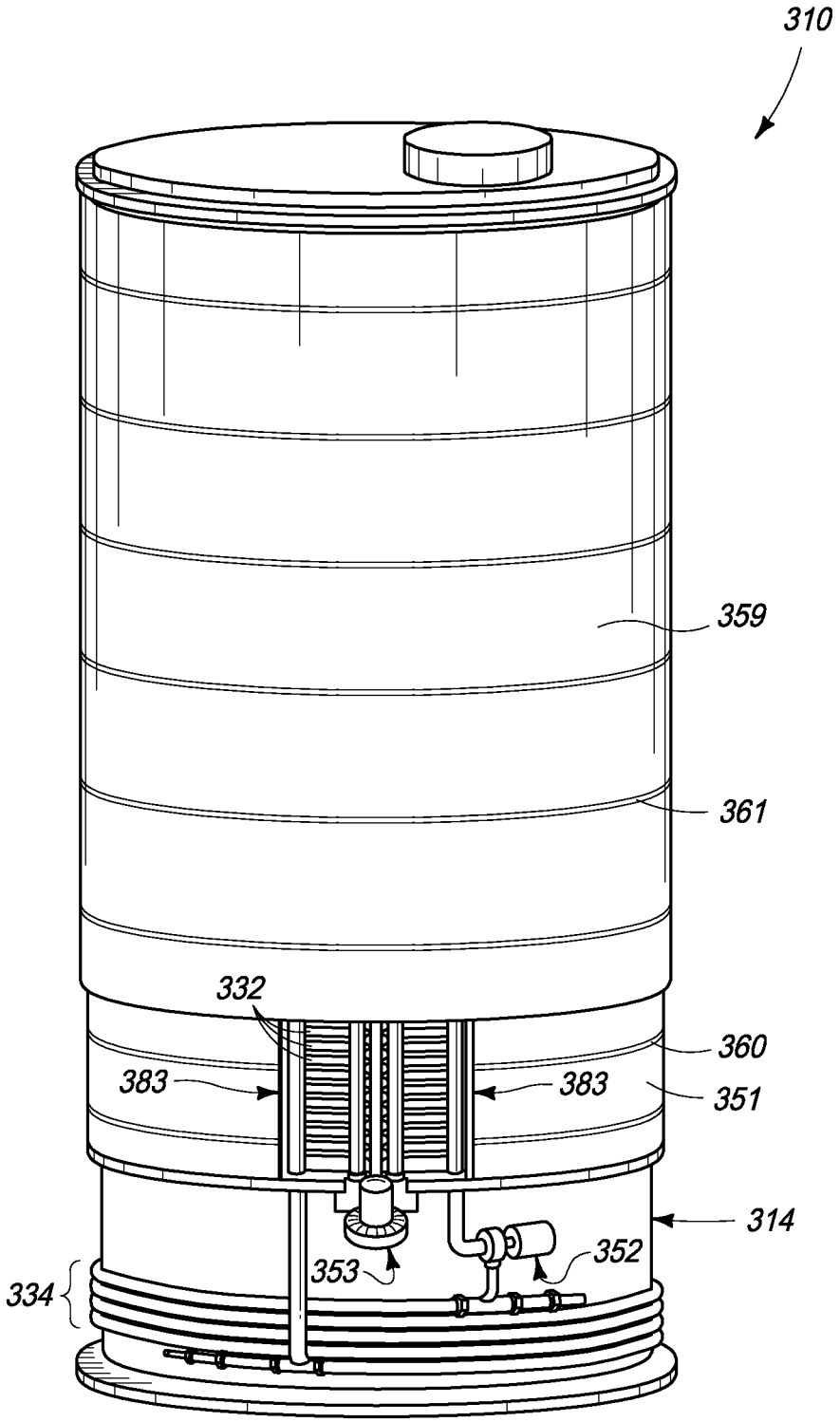
FIG. 9 is a perspective view of the FIG. 8 energy transfer system at a subsequent method step.

Referring to FIG. 9, energy transfer system 310 includes a second insulator 359 provided around the circumference of the tank 314 and covers a substantial portion of first insulator 351 along with a substantial portion of window 383. Straps 360 are provided around first insulator 351 to facilitate securement of first insulator 351 to tank 314 and straps 361 are provided around second insulator 359 to facilitate securement of second insulator 359 to tank 314.

Figure 10:
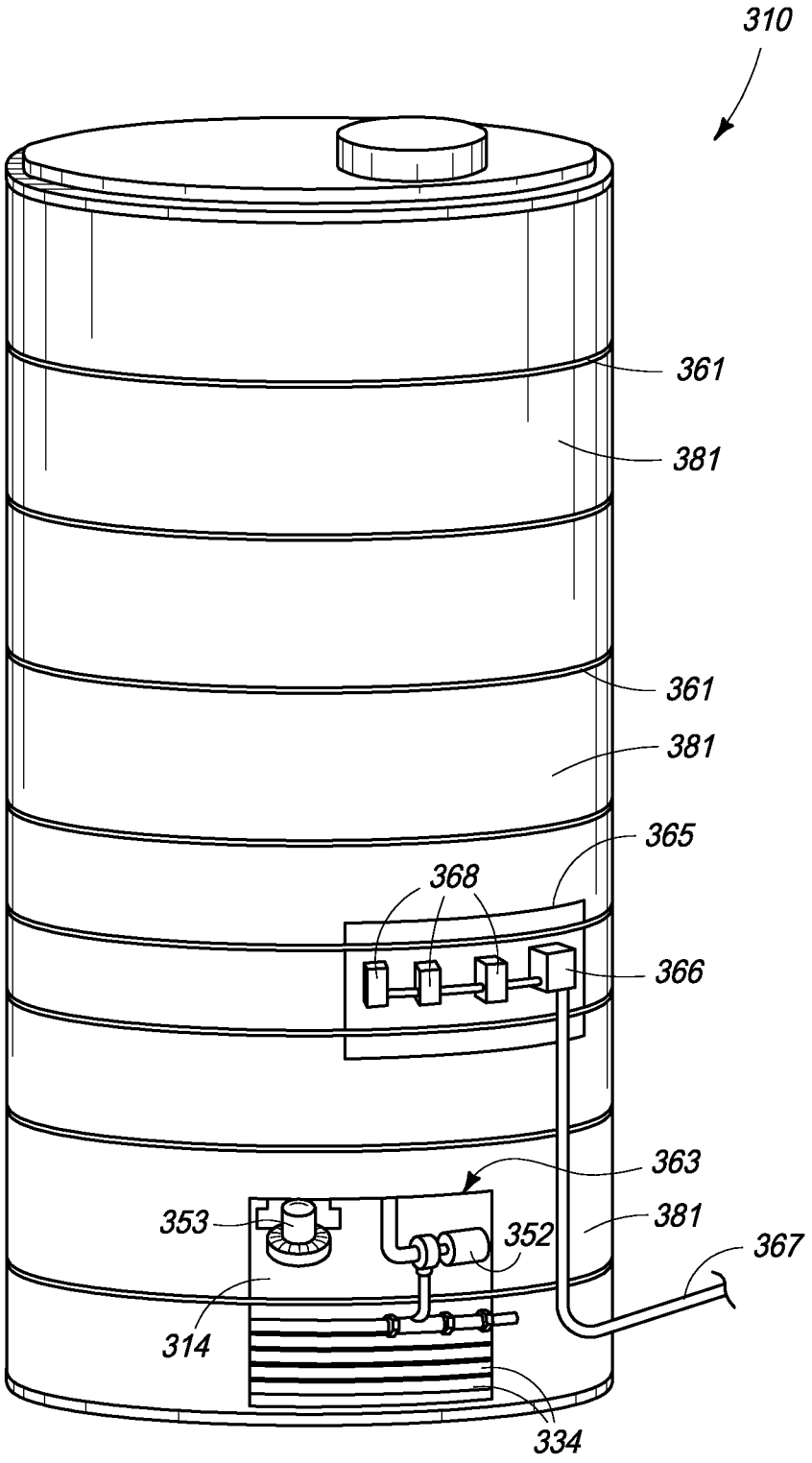
FIG. 10 is a perspective view of the FIG. 9 energy transfer system at a subsequent method step.

Referring to FIG. 10, energy transfer system 310 includes a third insulator 381 that surrounds substantially entirety of the circumference of tank 314 including substantially covering an entirety of first and second insulators 351 and 359. Third insulator 381 establishes a window 363. Window 363 provides easy access to blower 353 and pump 352 and exposes a portion of second fluid tube 334. A control panel 365 is secured to the third insulator 381 and includes a controller 366 and sensors 368, for example, temperature sensors and defrost timer. A heat pump interface cable and power source or supply 367 is in electrical/data communication with controller 366. In one embodiment, controller 366 corresponds to controller 114 of FIGS. 1 and 2; power source 367 corresponds to power source 129 of FIGS. 1 and 2 and sensors 368 correspond to sensors 128, 130, 132, 134 and 136 of FIGS. 1 and 2 (with the understanding that any one of the embodiments of energy transfer systems can include any number of sensors). First, second and third insulators 351, 359, and 381, singularly or in any combination, correspond to configuration 116 of FIGS. 1 and 2.

Still referring to FIG. 10, in another embodiment of energy transfer system 310, any one of the first, second and third insulators 351, 359, and 381 will surround an entirety of the circumference of tank 314 substantially sealing an entirety of tank 314 from the environment wherein the other insulators are not provided. Additionally, another embodiment of energy transfer system 310 includes any combination of the two insulators which cover the circumference of tank 314. Still further, yet another embodiment of energy transfer system 310 includes more than the three insulators discussed above to cover the circumference of tank 314. It should be understood that a cover (not shown) will be provided over window 363 thereby sealing the tank 314, including all the structure over the tank 314, from the environment.

Figure 11:
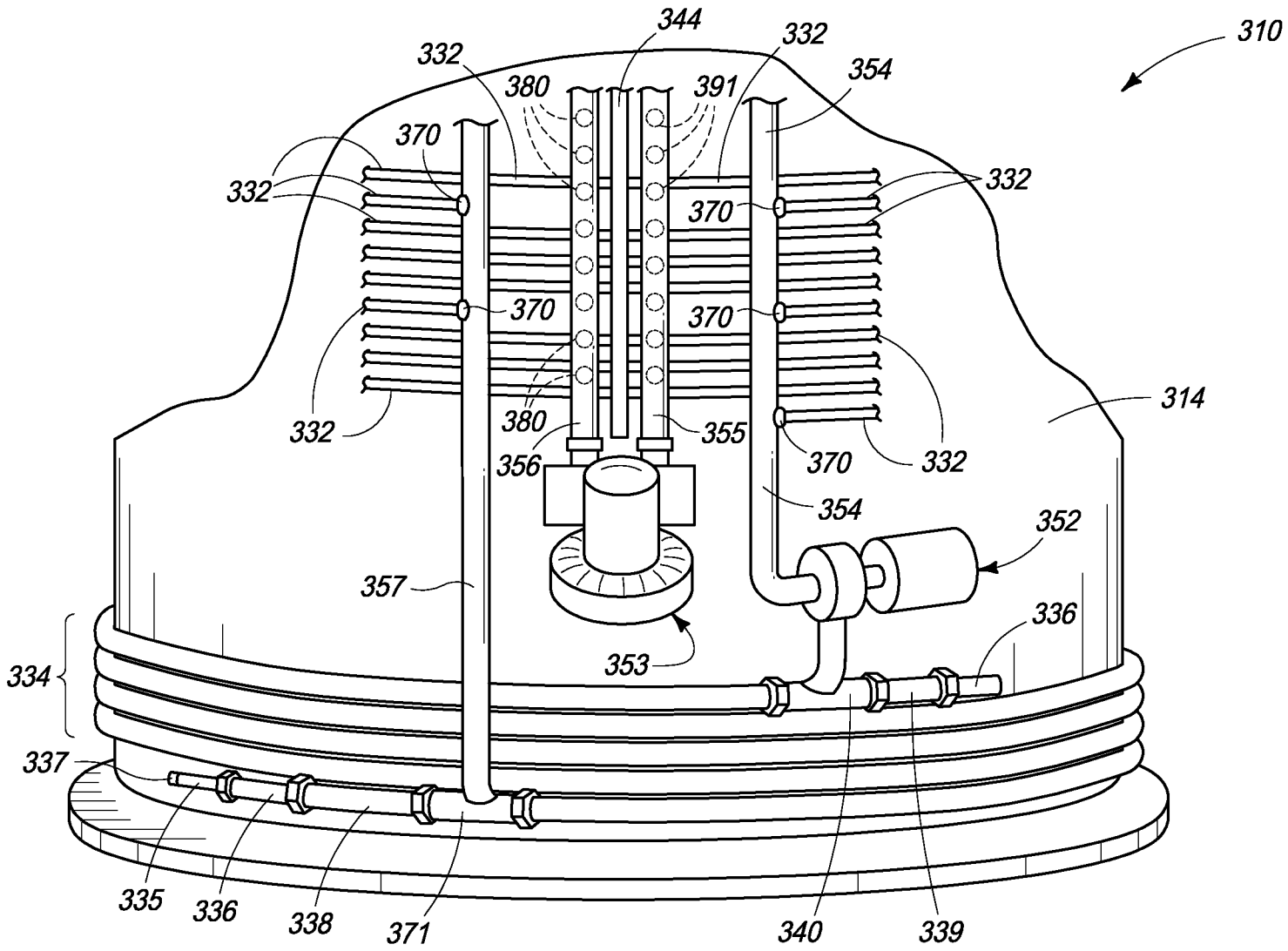
FIG. 11 is a partial break-away view of the FIG. 10 energy transfer system provided in a blown-up perspective.

Referring to FIG. 11, a break-away close up of a portion of tank 314 of energy transfer system 310 is illustrated. A plurality of openings 380 are formed in the return manifold 356. A plurality of openings 391 are formed in the source manifold 355. In one embodiment, the openings 380 and 391 are shown in dashed lines to indicate they are formed in the opposite side of return manifold 356 and source manifold 355 generally facing tank 314. However, openings 380 and 391 can be formed in sides opposite to that shown of return and source manifolds 355 and 356. In fact, with return and source manifolds 355 and 356 having a circular configuration, the openings 380 and 391 can be formed on any position of the circular periphery of the return and source manifolds 355 and 356. Accordingly, openings 380 and 391 can be located on the return and source manifolds 355 and 356 to be seen partially, or entirely, from this view of the page.

Still referring to FIG. 11, openings 380 and 391 can be formed to be angled relative to the tank 314, for example, configured to tangentially direct a fluid across tank 314 along, or parallel with, the direction of the first fluid tubes 332. Still further, openings 380 and 391 can be configured to direct a fluid generally perpendicularly against the tank 314. Additionally, with first fluid tubes 332 extending generally horizontally across tank 314, openings 380 and 391 can be formed to direct a fluid at an angle relative to the first fluid tubes 332. Openings 380 and 391 can be configured to direct a fluid at an angle ranging from about 0 degrees (being generally parallel with the first fluid tubes 332) to about 90 degrees relative to the orientation of the first fluid tubes 332. In one embodiment, openings 380 and 391 can be configured to direct a fluid at an angle of about 45 degrees relative to the orientation of the first fluid tubes 332.

In one embodiment of energy transfer system 310, the fluid traveling through openings 380 and 391 of the return manifold 356 and the source manifold 355 will be air presented from pump or blower 353. It should be understood that the blower 353 is simply recirculating the same volume of air through the system 310 and the air is not replenished or added to from ambient air. Accordingly, once the air is heated or cooled by the glycol, the recirculating air does not gain or lose any energy to the ambient or environment. However, energy will be transferred between the tank 314 and air. It should be understood that the air travels round the tank exterior from one side of the air dam 344 to the other side of the air dam 344 to enter the return manifold 356 for recycling/recirculating again through the blower 353 and out the source manifold 355 to begin the circuit around the tank 314 again. With the air dam 344, after the air exists the source manifold 355, the air must return to the manifold system through the return manifold 356 to the blower 353 again. During the travels of the air, it is bouncing back between the tank 314 exterior wall and the glycol pathway (first fluid tubes 332) transferring energy from one to the other.

Still referring to FIG. 11, energy transfer system 310 has inlet manifold 357 intersecting second fluid tube 334 in fluid communication at first T-section 371. Secured to the right side of first T-section 371 (in this view) extends second fluid tube 334. Secured to the left side of first T-section 371 (in this view) is a first rubber expansion tube adapter 338 with a sloping diameter size moving in direction to left of first T-section 371. That is, first rubber expansion tube adapter 338 has a diameter of approximately 1½ inches at the connection with the first T-section 371 and at the opposite end has a diameter of approximately ¾ inches. First rubber expansion tube adapter 338 accommodates the expansion and contraction, length-wise, of second fluid tube 334 as it is heated and alternatively cooled. The smaller end of first rubber expansion tube adapter 338 is secured to third fluid tube 336 which in one embodiment is a ¾ inch copper tube. Gaseous Freon® travels through third fluid tube 336. A ⅜ inch copper tube 335 is secured to the third fluid tube 336 and includes a threaded end 337 to be secured to a conduit ultimately leading to a heat pump (not shown) and receiving liquid Freon®. It should be understood that once the liquid Freon® in ⅜ inch copper tube 335 reaches the third fluid tube 336, the Freon® changes from the liquid state to the gaseous state.

Still referring to FIG. 11, energy transfer system 310 has outlet manifold 354 intersecting pump 352 and pump 352 in fluid communication with second fluid tube 334 at second T-section 340. Secured to the left side of second T-section 340 (in this view) is second fluid tube 334. Secured to the right side of second T-section 340 (in this view) is a second rubber expansion tube adapter 339. Second rubber expansion tube adapter 339 has a sloping diameter size moving in direction to the right of second T-section 340. That is, second rubber expansion tube adapter 339 has a diameter of approximately 1½ inches at the connection with the second T-section 340 and at the opposite end has a diameter of approximately ¾ inches. Second rubber expansion tube adapter 339 accommodates the expansion and contraction, length-wise, of second fluid tube 334 as it is heated and alternatively cooled. The smaller end of second rubber expansion tube adapter 339 is secured to third fluid tube 336 which ultimately will be secured in fluid communication with a heat pump (not shown). Gaseous Freon® travels through second T-section 340, via second copper tube 336 through the second rubber expansion tube adapter 339, and third fluid tube 336. It should be understood that third fluid tube 336 extends all the way through second fluid tube 334 from the second T-section 340 to the first T-section 371.

In one embodiment, energy transfer system 310 includes first fluid tubes 332 being divided into a plurality of sections, and each section in one embodiment, includes being provided almost four times around the circumference of tank 314. For example, at the beginning of one exemplary section of first fluid tube 332, the first fluid tube 332 extends from inlet manifold 357 in fluid communication at node 370. The section of first fluid tube 332 continues from node 370 of inlet manifold 357 to wrap around the circumference of tank 314 three complete times. Before the section of first fluid tube 332 completes a fourth wrap around the circumference of tank 314, the section of the first fluid tube 332 intersects the outlet manifold 354, in fluid communication, at another node 370.

In this embodiment, there are a plurality of distinct sections of first fluid tubes 332 along the length of each inlet and outlet manifolds 357 and 354. Each section of first fluid tubes 332 provides a fluid pathway from the inlet manifold 357, three complete trips around the circumference of the tank 314, and a fourth partial trip which is interrupted to intersect the outlet manifold 354 in fluid communication at another node 370. In other embodiments of energy transfer system 310, each one of the sections of first fluid tubes 332 can provide a pathway from the inlet manifold 357 to the outlet manifold 354 without circling the circumference of tank 314. Alternatively, other embodiments include first fluid tubes 332 providing one or more complete pathways around the circumference of the tank 314 before intersecting the outlet manifold 354: 0, 1, 2, 3, 4, 5, 6, 7, 8, 9 up to 25 complete pathways around the circumference of tank 314.

Moreover, different embodiments of energy transfer system 310 will include any number of the plurality of the sections of the first fluid tubes 332 along the length of respective inlet and outlet manifolds 357 and 354. The number of the sections can be the same number, or a different number, for the inlet manifold 357 relative to the outlet manifold 354. Moreover, an exemplary inlet manifold 357 can have sections with any number of pathways of first fluid tubes 332 around the circumference of tank 314 and have other different sections with any different number of pathways of first fluid tubes 332 around the circumference of tank 314. Still further, an exemplary outlet manifold 354 can have sections with any number of pathways of first fluid tubes 332 around the circumference of tank 314 and have other different sections with any different number of pathways of first fluid tubes 332 around the circumference of tank 314 (with the understanding that for all these variations of embodiments, each section of first fluid tubes 332 can include any number of the complete pathways around the circumference of tank 314 discussed above). The plurality of the sections of the first fluid tubes 332 along the respective lengths of the inlet and outlet manifolds 357 and 354 can range from about 0 to about 1000 sections.

In one exemplary embodiment for energy transfer system 310, the fluid (referred to additionally as a "first fluid") is configured to travel through the inlet manifold 357, outlet manifold 354 and first fluid tubes 332 and acts as an energy medium such as an energy source or supplier in the heating mode. That is, with the first fluid heated (or at least at a higher temperature than the contents of tank 314), ultimately thermal energy is transferred (supplied) from the first fluid, the energy supplier, to the contents of the tank 314 to be warmed. In one embodiment, the first fluid (energy source or supplier) is glycol, for example, as previously discussed.

Additionally, in another exemplary embodiment for energy transfer system 310, the same first fluid, or a different first fluid (still referenced as first fluid), is configured to travel through the inlet manifold 357, outlet manifold 354 and first fluid tubes 332 and acts as an energy medium such as an energy acceptor or receiver in the cooling mode for energy transfer system 310. That is, with the first fluid cooled (or at least at a lower temperature than the contents of tank 314), ultimately thermal energy is transferred from the contents of the tank 314 to be received or accepted by the first fluid, the energy acceptor. Accordingly, the contents of tank 314 are cooled. In one embodiment, the first fluid in the energy acceptor or receiver state is glycol, for example, as previously discussed.

However, the first fluid (whether the energy supplier or acceptor) alone is inefficient and ineffective for transferring energy from, or to, the contents of tank 314. The inventor has discovered that introducing a second fluid realizes an efficient and effective transference of thermal energy from, or to, the contents of tank 314. The second fluid is that which travels through the return manifold 356, source manifold 355 and blower or pump 353 and acts as an energy transfer medium such as an energy transferor. In one embodiment, the second fluid is air referred to previously.

Accordingly, blower 353 forces the second fluid, air, into the source manifold 355 and through openings 391. Blower 353 continues to force the air to move over and against the outlet manifold 354, over and against sections of the first fluid tubes 332, and over and against the tank wall 317 around the circumference of tank 314. Insulators 351, 359 and 381 of energy transfer system 310 discussed previously maintain the second fluid proximate the tank 314. The forced air circles the tank 314 to move over and against the inlet manifold 357 to be ultimately forced into openings 380 of return manifold 356. Air dam 344 prevents the second fluid from circling around an entirety of the circumference of the tank 314. Only the openings 380 of return manifold 356 are available to receive the air which is under pressure from blower 353, through source manifold 355, to continue its travels, and therefore, the air enters the return manifold 356 and ultimately to the blower 353 to be re-forced/recirculated/recycled around a substantial portion of the circumference of the tank 314 (but for the air dam 344 which prevents the air from source manifold 355 from going directly back to return manifold 356). In this manner, the second fluid, air, acts as the transferor of the thermal energy for energy transfer system 310 as the first fluid, glycol, travels through the inlet manifold 357, outlet manifold 354 and first fluid tubes 332. That is, the air bounces back and forth to contact tank 314 and the glycol pathways (first fluid tubes 332) to transfer energy between the tank 314 and the glycol pathways.

Explained more thoroughly below, in the cooling mode, thermal energy from the contents of the tank 314 is transferred through the tank wall 317 and into the second fluid, the air. As the air circulates around tank 314, the thermal energy in the air is transferred from the air into the sections of the first fluid tubes 332 into the first fluid, glycol. The thermal energy in the glycol is ultimately transferred to the environment, thus cooling the contents of the tank 314.

Still further and stated more thoroughly below, in the heating mode, thermal energy from the first fluid, glycol, is transferred from the first fluid tubes 332 into the second fluid, the air, as the air circulates around tank 314. As the air continues to circulate, the thermal energy in the air is transferred through the tank wall 317 into the contents of the tank 314, thus heating the contents of the tank 314.

It should be understood that any of the various embodiments of inventions described for an energy transfer system described in this document, that the first fluid can be cooled, or heated, from an apparatus/structure remote from the energy transfer system, for example, the heat pump apparatus 112 of energy transfer system 110. Further, it should be understood that any of the various embodiments of inventions described for an energy transfer system described in this document, that the first fluid can be cooled, or heated, from an apparatus/structure that is proximate the energy transfer system, and even at least partially supported upon the tank of the system, for example, the second fluid tube 334 structure of energy transfer system 310.

Still referring to FIG. 11 and energy transfer system 310 in the cooling mode, glycol in a cooled state enters the inlet manifold 357 from the second fluid tube 334 configuration. In the heating mode, glycol in a heated state enters the inlet manifold 357 from the second fluid tube 334 configuration. In either operation mode (heating or cooling), glycol then enters the first fluid tubes 332 extending from the inlet manifold 357 through a plurality of nodes 370 spaced vertically along the inlet manifold 357. Each node 370 in inlet manifold 357 represents a new section of the first fluid tubes 332. In each section of the first fluid tubes 332, the glycol travels around the circumference of the tank 314 a full three times and before finishing the fourth trip enters the outlet manifold 354 through another node 370. Each node 370 in the outlet manifold 354 represents the finishing of one of the plurality of sections of the first fluid tubes 332.

In the cooling mode, and as the glycol travels around the tank 314 and enters the outlet manifold 354, the glycol warms as thermal energy is transferred, via the second fluid (air), to the glycol from the contents of the tank 314. Alternatively, in the heating mode, and as the glycol travels around the tank 314 and enters the outlet manifold 354, the glycol cools as thermal energy is transferred, via the second fluid (air), to the contents of the tank 314 from the glycol. In either operation mode, pump 352 moves the glycol through these structures of system 310 and from the outlet manifold 354, glycol is moved into the second fluid tube 334.

As glycol travels through the second fluid tube 334, the glycol is also traveling over and against the third fluid tubes 336 which are positioned to extend through the larger diameter of the second fluid tube 334 discussed previously. Also discussed previously, Freon® moves through the third fluid tubes 336. The Freon® is provided to move through the third fluid tubes 336 in a cooled state in the cooling mode of operation for system 310. In this manner, the warmed glycol (having previously received thermal energy from the contents of the tank 314) releases thermal energy to the Freon® wherein the glycol is cooled and re-cooled to circulate through system 310 again to continue cooling the contents of tank 314.

Alternatively, the Freon® is provided to move through the third fluid tubes 336 in a heated state in the heating mode of operation for system 310. In this manner, the cooled glycol (having previously provided thermal energy to the contents of tank 314) receives thermal energy from the Freon® wherein the glycol is heated and reheated to circulate through the system 310 again to continue heating the contents of tank 314.

Figure 12:
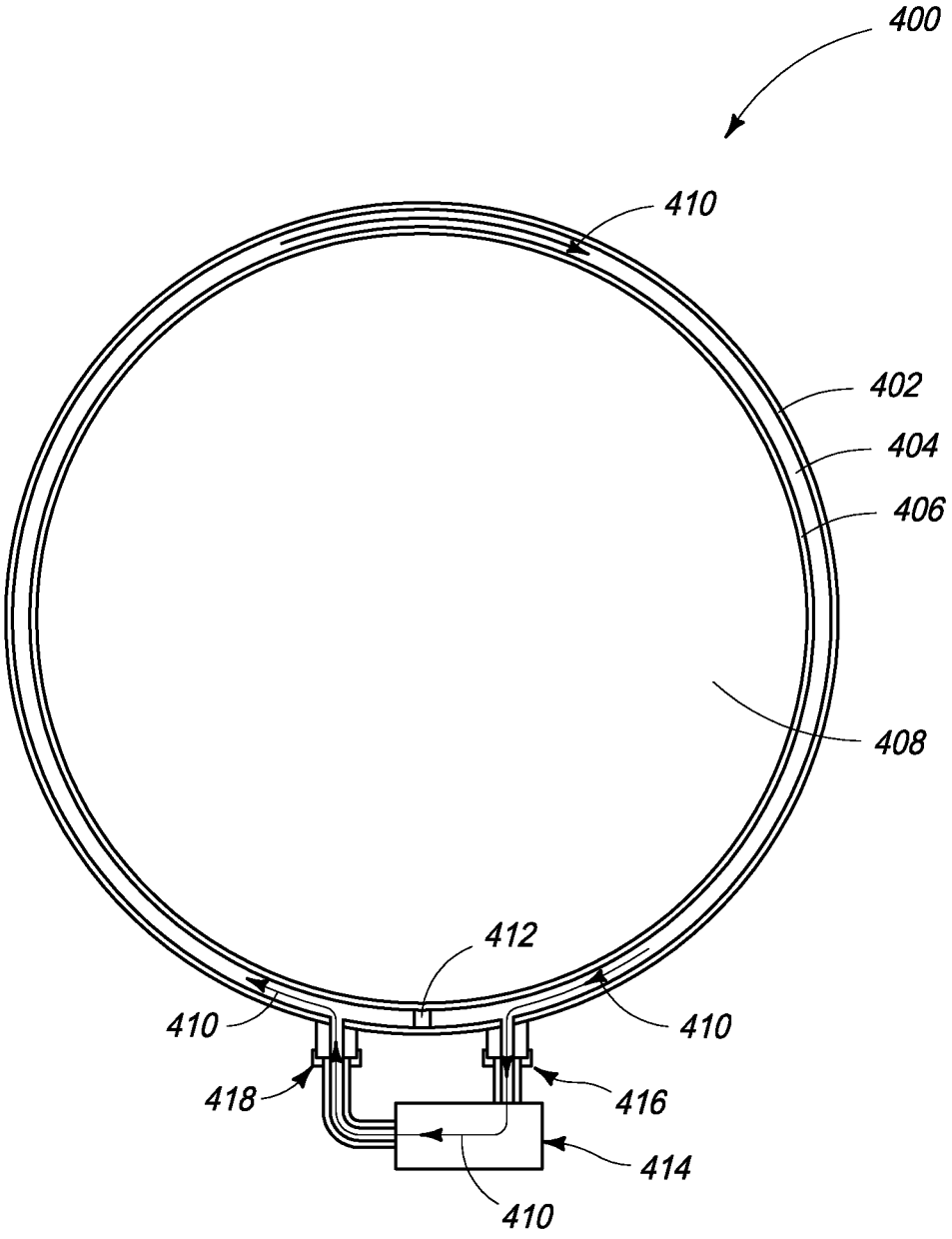
FIG. 12 is a sectional view of an exemplary energy transfer system according to one of various embodiments of the invention.

FIG. 12 illustrates an exemplary one of various embodiments of the inventions and is directed to an energy transfer system 400 and methods for using same. Energy transfer system 400 is capable of transferring energy to, or from, configuration 408 which can represent a mass, structure, solid, liquid, fluid, gas, and for ease of discussion, a tank having an outer wall 406. A shell 402 forms a cavity 404 with tank 408 between outer wall 406 and shell 402. A range of distances for cavity 404 measured between the outer wall 406 and shell 402 include from about 0.001 inch to about 20 inches. A recirculating pump 414 is in fluid communication with cavity 404 via conduits 416 and 418. The recirculating pump 414 circulates a fluid 410, for example a gas, through conduits 416, 418 and through cavity 404. Shell 402 can represent an energy medium, and therefore, can be heated or cooled depending on the desired mode for tank 408. In one embodiment, shell 402 is heated or cooled by the environment. Alternatively, shell 402 can be heated or cooled by other methods, such as by flame or any method described in this document. As fluid 410 moves through cavity 404, the fluid 410 bounces back and forth to contact shell 402 and outer wall 406 of tank 408. The fluid 410 transfers energy between shell 402 and outer wall 406 of tank 408. Air dam 412 prevents the fluid 410 from completely cycling around tank 408 and allows for recirculation of the same volume of fluid 410 without having to replenish fluid 410.

Still referring to FIG. 12, the pressures and volumes of the pump varies greatly in order to match the particular application of use of the system. In general, the pressure goes up as the spacing goes down and the volume goes up as the spacing goes up. For a spacing of ¼ inch, it would be different for a spacing of 1/100 inch.

Figure 13:
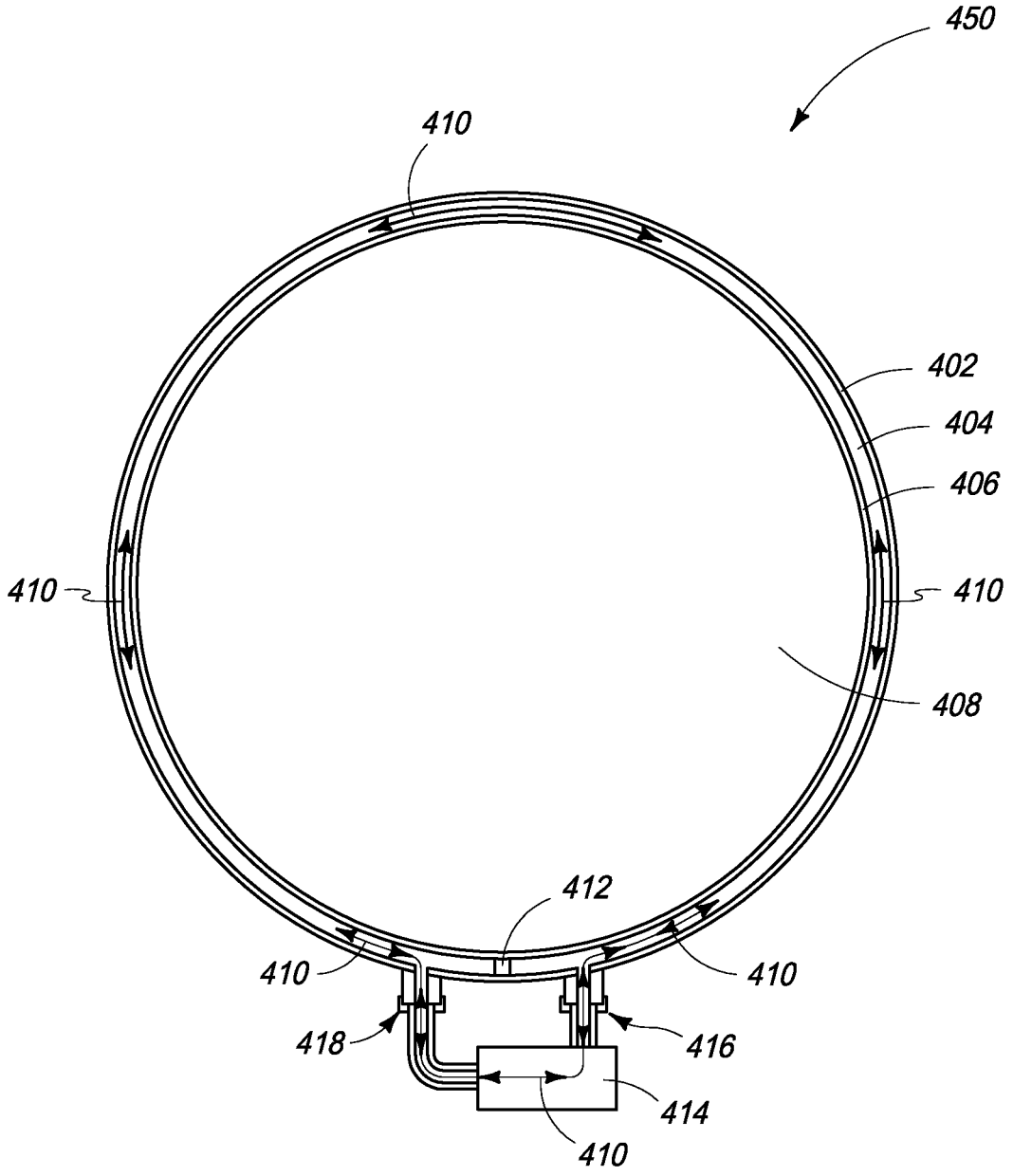
FIG. 13 is a sectional view of an exemplary energy transfer system according to one of various embodiments of the invention.

FIG. 13 illustrates an exemplary one of various embodiments of the inventions and is directed to an energy transfer system 450 and methods for using same. Energy transfer system 450 is capable of transferring energy to, or from, configuration 408 which can represent a mass, structure, solid, liquid, fluid, gas, and for ease of discussion, a tank having an outer wall 406. A shell 402 forms a cavity 404 with tank 408 between outer wall 406 and shell 402. A range of distances for cavity 404 measured between the outer wall 406 and shell 402 include from about 0.001 inch to about 20 inches. For energy transfer system 450, structure 414 represents an extra low frequency (ELF) source in fluid communication with cavity 404 via conduits 416 and 418. In other embodiments, structure 414 represents a diaphragm pump, a billows pump and/or a liquid piston pump.

Still referring to FIG. 13, an exemplary extra low frequency (ELF) source 414 is an oscillating pump 414 that circulates in reciprocal fashion sound waves 410 through conduits 416, 418 and through cavity 404. Shell 402 can represent an energy medium, and therefore, can be heated or cooled depending on the desired mode for tank 408. In one embodiment, shell 402 is heated or cooled by the environment. Alternatively, shell 402 can be heated or cooled by other methods, such as by flame or any method described in this document. As sound waves 410 move through cavity 404 in a reciprocal fashion, the sound waves 410 bounce back and forth to contact shell 402 and outer wall 406 of tank 408. In this manner, sound waves 410 transfer energy between shell 402 and outer wall 406 of tank 408. Air dam 412 facilitates the reciprocal motion of sound waves 410.

Figure 14:
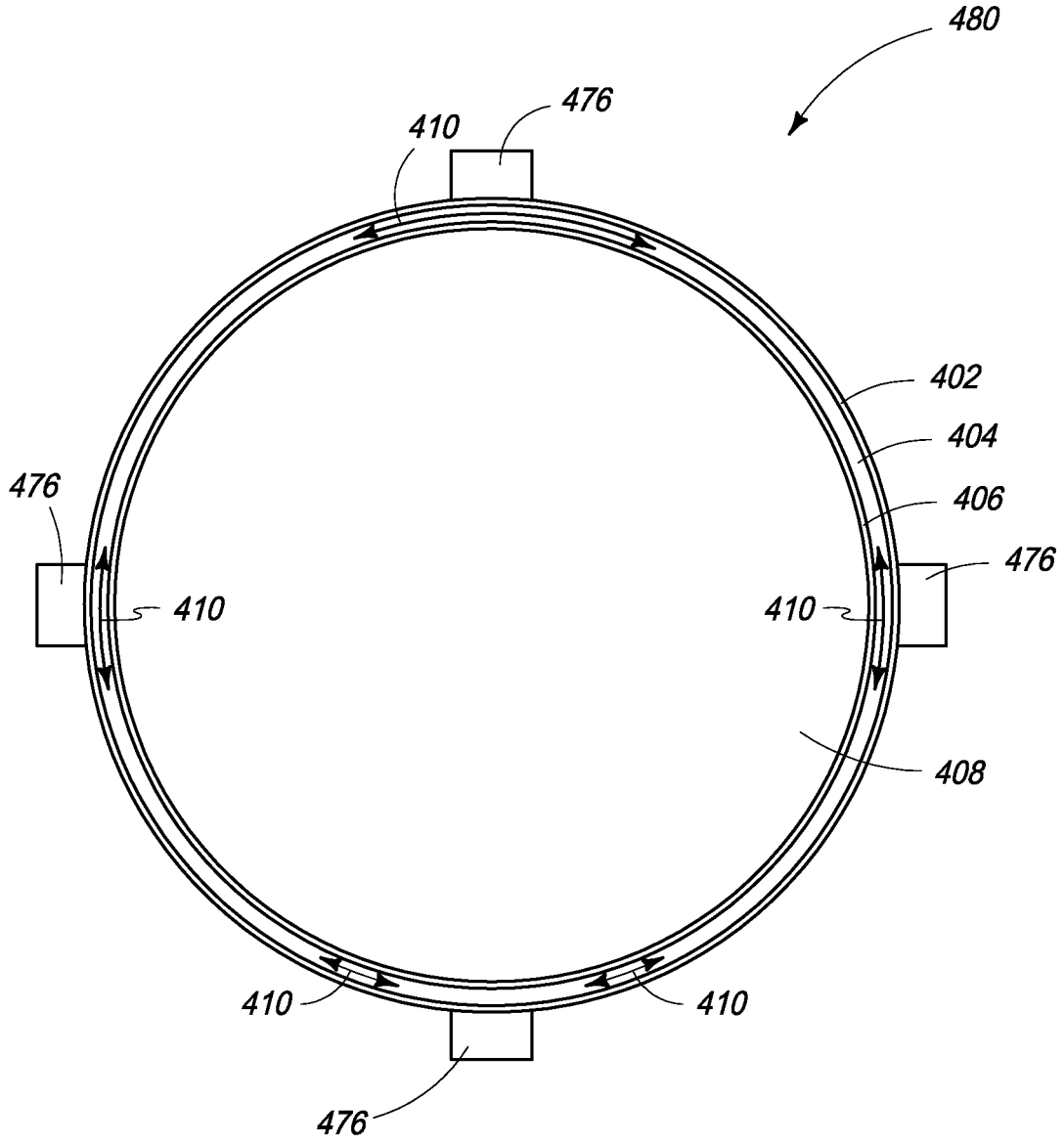
FIG. 14 is a sectional view of an exemplary energy transfer system according to one of various embodiments of the invention.

FIG. 14 illustrates an exemplary one of various embodiments of the inventions and is directed to an energy transfer system 480 and methods for using same. Energy transfer system 480 is capable of transferring energy to, or from, configuration 408 which can represent a mass, structure, solid, liquid, fluid, gas, and for ease of discussion, a tank having an outer wall 406. A shell 402 forms a cavity 404 with tank 408 between outer wall 406 and shell 402. A range of distances for cavity 404 measured between the outer wall 406 and shell 402 include from about 0.001 inch to about 20 inches. For energy transfer system 480, a plurality of transducers 476 are positioned proximate shell 402. In one embodiment, the transducers are ELF transducers and/or piezoelectric transducers, and in any combination of different transducers. In one embodiment, transducers 476 are secured to shell 402.

Still referring to FIG. 14, transducers 476 circulate sound waves 410 through cavity 404 in a reciprocal fashion. Shell 402 can represent an energy medium, and therefore, can be heated or cooled depending on the desired mode for tank 408. In one embodiment, shell 402 is heated or cooled by the environment. Alternatively, shell 402 can be heated or cooled by other methods, such as by flame or any method described in this document. As sound waves 410 move through cavity 404 in a reciprocal fashion, the sound waves 410 bounce back and forth to contact shell 402 and outer wall 406 of tank 408. In this manner, sound waves 410 transfer energy between shell 402 and outer wall 406 of tank 408.

Figure 15B:
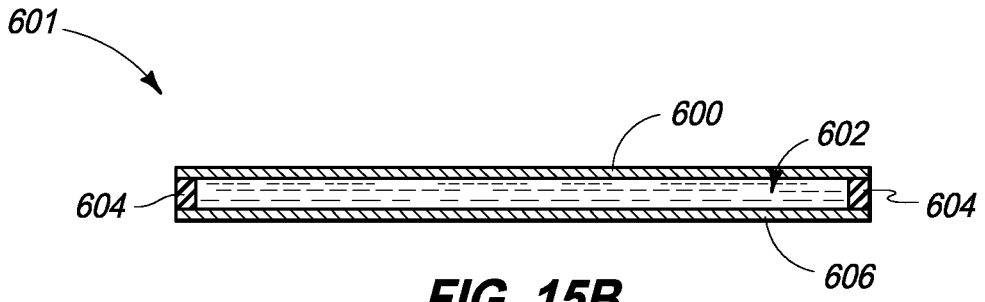
FIG. 15B is a cross-sectional view of FIG. 15A taken along lines 15B-15B.
Figure 15A:
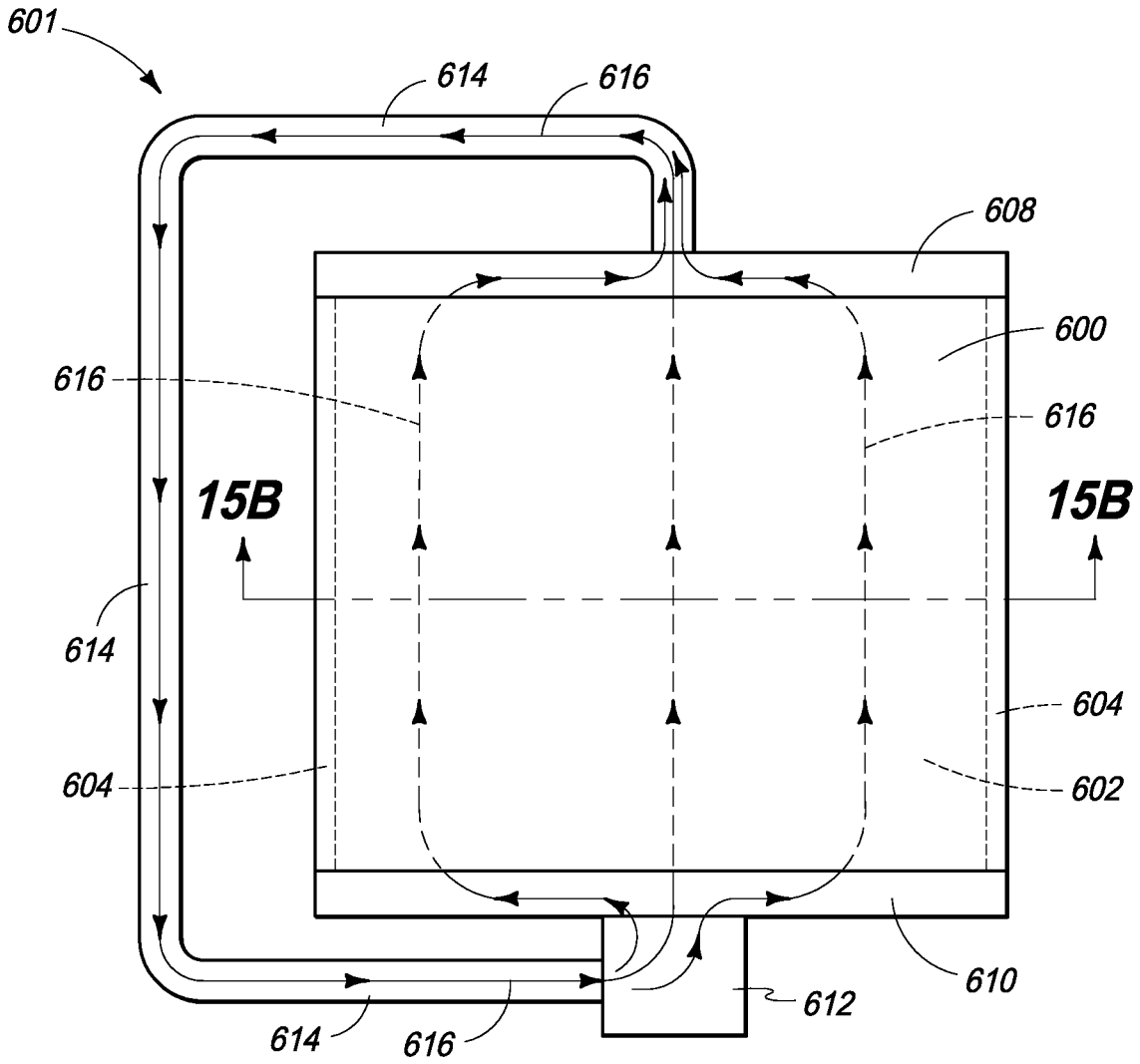
FIG. 15A is a top view of an exemplary energy transfer system according to one of various embodiments of the invention.

FIGS. 15A and 15B illustrate an exemplary one of various embodiments of the inventions and are directed to an energy transfer system 601 and methods for using same. Energy transfer system 601 is capable of transferring energy between plates, surfaces or substrates. A first substrate 600 can represent a substrate that is to be heated or cooled, and therefore, energy (thermal energy) is to be provided to, or away from, first substrate 600. In one embodiment, first substrate 600 is a semiconductor substrate. Spaced from first substrate 600 is a second plate, surface or substrate 606 that acts as an energy medium and will provide, or receive, the energy from first substrate 600. Second substrate 606 forms a cavity 602 (FIG. 15B) with first substrate 600. A range of distances for cavity 602 measured between first and second substrates 600 and 606 include from about 0.001 inch to about 20 inches. Seals 604 fluidly seal the cavity 602 between surfaces of respective first and second substrates 600 and 606. In one embodiment, seals 604 are formed of rubber material.

Referring to FIG. 15A, an operational method for energy transfer system 601 will be described. Distribution manifolds 608 and 610 are positioned at opposite ends of first and second substrates 600 and 606 to fluidly enclose, in combination with seals 604, cavity 602 from the environment. Distribution manifolds 608 and 610 are in fluid communication with cavity 602. Furthermore, a pump 612 is in fluid communication with distribution manifold 610. In one embodiment, pump 612 is a fluid pump wherein the fluid is air, and therefore, pump 612 is a blower. Conduit 614 forms a fluid pathway between distribution manifold 608 and blower 612.

In operation, blower 612 moves air 616 through distribution manifolds 610, through cavity 602, through distribution manifolds 608 and into conduit 614 for air 616 to return to the blower 612 to be recirculated over in cavity 602 against first and second substrates 600 and 606. As air 616 is moved into cavity 602, the air 616 bounces between contacting first and second substrates 600 and 606 to provide thermal energy between first and second substrates 600 and 606. In this manner, first substrate 600 is heated or cooled. It should be understood that second substrate 606 can be heated or cooled in any manner discussed in this document. It should be further understood that air 616 is shown in dashed lines to indicate when air 616 is traveling through cavity 602.

The invention claimed is:

1. An energy transfer system comprising:

a tank comprising an outer wall having a circumference;

a plurality of first fluid pathways surrounding a portion of the circumference of the tank, a portion of the circumference of the tank exposed between each discrete one of the plurality of the first fluid pathways;

a second fluid pathway sealing the portion of the circumference of the tank and the plurality of first fluid pathways from the environment; and a third fluid pathway spaced from the plurality of the first fluid pathways, and separate and distinct from the second fluid pathway, the third fluid pathway surrounding another portion of the circumference of the tank.

2. The energy transfer system of claim 1 further comprising a blower in fluid communication with the second fluid pathway.

3. The energy transfer system of claim 1 wherein the plurality of the first fluid pathways is configured as a coil surrounding the circumference of the tank.

4. The energy transfer system of claim 1 wherein each discrete one of the plurality of the first fluid pathways is a tubular structure.

5. The energy transfer system of claim 4 wherein the tubular structure comprises a diameter ranging from ⅛ Inch to one inch.

6. The energy transfer system of claim 1 wherein each of the plurality of the first fluid pathways comprises a polyethene material.

7. The energy transfer system of claim 1 wherein a spacing distance between each discrete one of the plurality of the first fluid pathways comprises a distance ranging from 1 inch to 6 inches.

8. The energy transfer system of claim 1 further comprising a fourth fluid pathway extending through the third fluid pathway.

9. The energy transfer system of claim 1 wherein:

the plurality of the first fluid pathways comprises glycol; and the second fluid pathway comprises a gas.

10. The energy transfer system of claim 9 wherein the third fluid pathway comprises glycol.

11. The energy transfer system of claim 8 wherein the third fluid pathway comprises liquid and the fourth fluid pathway comprises a gas.

12. The energy transfer system of claim 8 wherein the second fluid pathway comprises a first composition of gas and the fourth fluid pathway comprises a second composition of gas different from the first composition of gas.

13. The energy transfer system of claim 8 wherein the fourth fluid pathway comprises freon.

14. The energy transfer system of claim 8 wherein the second fluid pathway comprises air and the fourth fluid pathway comprises freon.

15. The energy transfer system of claim 1 wherein the plurality of the first fluid pathways and the third fluid pathway are in fluid communication.

16. An energy transfer method comprising:

providing a tank comprising an outer wall having a circumference;

providing a first pathway structure around a circumference of the tank, the first pathway structure comprising vertically spaced sections that expose portions of the circumference of the tank between each spaced section of the first pathway structure;

circulating a first fluid through the first pathway structure; and circulating a first gas against the first pathway structure and against the exposed portions of the circumference of the tank between each vertically spaced section of the circumference of the tank; and circulating a second gas around a portion of the circumference of the tank, the second gas comprising a composition different from a composition of the first gas.

17. The energy transfer method of claim 16 wherein the first fluid comprises a liquid.

18. The energy transfer method of claim 17 wherein the liquid comprises glycol.

19. The energy transfer method of claim 16 wherein the gas comprises air.

20. The energy transfer method of claim 16 wherein the circulating of the gas comprises circulating the gas through, and out of, an outlet manifold.

21. The energy transfer method of claim 16 wherein the circulating of the gas comprises receiving the gas into an inlet manifold.

22. The energy transfer method of claim 16 wherein the circulating of the gas comprises continually circulating the same volume of gas.

23. The energy transfer method of claim 16 wherein the pathway structure is configured as a coil surrounding the circumference of the tank.

24. The energy transfer method of claim 16 wherein the pathway structure is a tubular structure.

25. The energy transfer method of claim 24 wherein the tubular structure comprises a diameter ranging from ⅛ inch to one inch.

26. The energy transfer method of claim 16 wherein the pathway structure comprises a polyethene material.

27. The energy transfer method of claim 16 wherein the second gas is circulated through a second pathway structure different from the first pathway structure.

28. The energy transfer method of claim 27 wherein the second pathway structure extends through a third pathway structure.

29. The energy transfer method of claim 28 further comprising circulating a fluid through the third pathway structure.

30. The energy transfer method of claim 16 wherein the second gas comprises freon.

31. The energy transfer method of claim 16 wherein:

the first gas comprises air; and the second gas comprises freon.

* * * * *